US005280129A

United States Patent [19]

Yamamori et al.

[11] Patent Number: 5,280,129

[45] Date of Patent: Jan. 18, 1994

[54] ASSIGNING DEVICE WHICH ASSIGNS NEW MUSICAL TONES TO TONE-GENERATING CHANNELS BASED UPON A SUCCESSIVE STRIKE RELATION AMONG THE CHANNELS

[75] Inventors: Takenori Yamamori; Tsuyoshi Sakata; Minoru Fujisawa, all of Hamamatsu, Japan

[73] Assignee: Roland Corporation, Japan

[21] Appl. No.: 883,876

[22] Filed: May 15, 1992

Related U.S. Application Data

[63] Continuation-in-part of Ser. No. 835,437, Feb. 21, 1992, abandoned.

[30] Foreign Application Priority Data

Aug. 6, 1990 [JP] Japan ..... 2-208654
Aug. 24, 1990 [JP] Japan ..... 2-223301

[51] Int. Cl.[5] ..... G10H 5/00; G10H 1/22
[52] U.S. Cl. ..... 84/656; 84/618
[58] Field of Search ..... 84/617, 618, 655, 656, 84/615, 653

[56] References Cited

U.S. PATENT DOCUMENTS

Re. 31,931 7/1985 Tomisawa ..... 84/653 X
4,703,680 11/1987 Wachi et al. ..... 84/615
4,706,538 11/1987 Yoshida ..... 84/656 X
4,984,497 1/1991 Inagaki et al. ..... 84/626
5,095,800 3/1992 Matsuda ..... 84/618
5,107,747 4/1992 Saito ..... 84/658 X
5,123,323 6/1992 Fujita et al. ..... 84/633 X
5,159,144 10/1992 Fujisawa et al. ..... 84/656

*Primary Examiner*—William M. Shoop, Jr.
*Assistant Examiner*—Jeffrey W. Donels
*Attorney, Agent, or Firm*—Beveridge, DeGrandi, Weilacher & Young

[57] ABSTRACT

An assigning device of an electronic musical instrument for selecting a musical tone-generating channel to assign a new musical tone is disclosed. The object of the invention is to minimize the sense of incongruity in a musical performance upon determining, preliminarily, the preferential order for the assignment of a new musical tone to the musical tone-generating channels.

As to the musical tone-generating channels with the successive strike relation detected from among the channels being in a musical sound-generating condition, the content subject of the predetermined preferential order rule is altered. This altering is conducted so that the above-mentioned musical tone-generating channels with the successive strike relation are preferentially selected, and are assigned with new musical tones, according to the assigning order based on the predetermined preferential order rule, at least among musical tone-generating channels in the sound-generating condition. Under the altered content of the preferential order rule, the order of assigning a new musical tone to each channel is preliminarily determined according to the assigning order based on the predetermined preferential order rule.

13 Claims, 19 Drawing Sheets

| NOTE NUMBER | NOTE STATUS | SOSTENUTO STATUS |
|---|---|---|
| 0 | | |
| 1 | | |
| 2 | | |
| ⋮ | | |

| ENVELOPE CHANNEL NO. | ENVELOPE LEVEL | TARGET VALUE | RATE | PHASE NUMBER | TRUNCATE INHIBIT PHASE NO. | ENVELOPE GEN. PARA. | | | |
|---|---|---|---|---|---|---|---|---|---|
| 0 | | | | | | | | | |
| 1 | | | | | | | | | |
| 2 | | | | | | | | | |
| ⋮ | | | | | | | | | |

FIG. 4

| TASK NUMBER | TIMER PROCESSING REQUEST FLAG | STATUS | WAIT EVENT VALUE | EVENT OCURRING FLAG | |
|---|---|---|---|---|---|
| | | | | FIRST EVENT | SECOND EVENT |
| 1 | | | | | |
| 2 | | | | | |
| 3 | | | | | |
| ⋮ | | | | | |

FIG. 5

| MUSICAL TONE-GENERATING CHANNEL NO. | SOUND GEN. VOLUME | TRUNCATE INHIBIT FLAG | FAST DAMPING | PROCESSING WAIT FLG. | | | NOTE NUMBER | VELOCITY | MUSICAL TONE-GENERATING PARA. |
|---|---|---|---|---|---|---|---|---|---|
| | | | | 1 | 2 | 3 | | | |
| 0 | | | | | | | | | |
| 1 | | | | | | | | | |
| 2 | | | | | | | | | |
| ⋮ | | | | | | | | | |

ASSIGNING DEVICE WHICH ASSIGNS NEW MUSICAL TONES TO TONE-GENERATING CHANNELS BASED UPON A SUCCESSIVE STRIKE RELATION AMONG THE CHANNELS

This application is a continuation-in-part of application Ser. No. 07/835,437 now abandoned, filed Feb. 21, 1992.

BACKGROUND OF THE INVENTION

1. Field of the Invention

This invention relates to an assigning device of an electronic musical instrument which selects a musical tone-generating channel to assign a new musical tone, or more particularly to a technique to assign a new musical tone of successive strike.

2. Description of the Prior Art

Conventionally, the above-mentioned assigning device of an electronic musical instrument determines preliminarily selecting the order of a musical tone-generating channel for assigning a new musical tone as follows.

(1) The order to select a musical tone-generating channel is determined according to the order in which a musical tone is assigned by depressing a key or namely a note-on message.

(2) The order to select the musical tone-generating channel is determined in the order of lower envelope level of an assigned musical tone.

By the way, as for assigning musical tones generated by successive strikes, considering the masking effect between musical tones of successive strikes, it is effective to preliminarily limit the number of musical tone-generating channels for successive strikes and to assign new musical tones of successive strikes within the limited number of the tone-generating channels, rather than assigning individual new musical tones of successive strikes to different musical tone-generating channels. This is because of the following reason:

Although musical tones of successive strikes generated by musical tone-generating channels have little influence on musical performance, when the number of the musical tone-generating channels is not limited in assigning musical tones of successive strikes, new musical tones of successive strikes are assigned, according to the aforementioned preliminarily determined selection order, to the tone-generating channels which have been generating musical tones effective for musical performance. Consequently, the musical tones effective for musical performance are muted one after another by the new musical tones of successive strikes, thus giving the sense of incongruity.

However, simply limiting the number of the musical tone-generating channels for musical tones of successive strike also give incongruous effect on the performance for the following reason: When the assignment of musical tones of successive strikes has reached the limited number, a new musical tone of successive strikes is assigned to a channel which is already generating a musical tone of successive strikes assigned to the channel even if there are unoccupied channels which have finished generating musical tones.

To solve the above problems, the object of the present invention is to provide an assigning device of an electronic musical instrument, capable of minimizing the sense of incongruity in the musical performance on determining preliminarily the preferential order for assignment of a new musical tone to a musical tone-generating channel, and more generally, determining a musical tone-generating channel for assigning a new musical tone of successive strike.

SUMMARY OF THE INVENTION

To attain the above object, the first invention provides an assigning device of an electronic musical instrument which selects a musical tone-generating channel to assign a new musical tone, basically, comprising:

(a) successive-strike detecting means for detecting musical tone-generating channels with a successive strike relation, from among the channels which are in sound-generating condition;

(b) altering means for altering the content subject of a predetermined preferential order rule so that a musical tone-generating channel that is detected by the detecting means and has the successive strike relation is preferentially selected at least among the musical tone-generating channels in the sound-generating condition to be assigned with a new musical tone, according to the assigning order based on the predetermined preferential order rule; and (c) order selecting means for preliminarily determining the order of selecting a musical tone-generating channel to which a new musical tone is assigned according to the assigning order based on the predetermined preferential order rule under the content subject of the predetermined preferential order rule and to be altered by the altering means.

As to the musical tone-generating channels with the successive strike relation detected from among the channels being musical sound-generating condition, the "content subject" or "subject" of the predetermined preferential order rule is altered. This altering is conducted so that the above-mentioned musical tone-generating channels with the successive strike relation are preferentially selected, and are assigned with new musical tones, according to the assigning order based on the predetermined preferential order rule at least among musical tone-generating channels in the sound-generating condition. Under the altered content of the preferential order rule, the order of assigning a new musical tone to each channel is preliminarily determined according to the assigning order based on the predetermined preferential order rule.

To attain the above object, the second invention provides an assigning device of an electronic musical instrument which selects a musical tone-generating channel to assign a new musical tone, basically comprising:

(a) successive-strike detecting means for detecting musical tone-generating channels with a successive strike relation, from among the channels which are in sound-generating condition;

(b) altering means for altering the content subject of a predetermined preferential order rule so that a musical tone-generating channel that is detected by the detecting means and has the successive strike relation is preferentially selected at least among the musical tone-generating channels in the sound-generating condition to be assigned with a new musical tone, according to the assigning order based on the predetermined preferential order rule; and (c) channel selecting means for selecting a musical tone-generating channel to assign a new musical tone based on the predetermined preferential order rule under the content subject of the predetermined preferential order rule and to be altered by the altering means.

As to the musical tone-generating channels with the successive strike relation detected from among the channels being musical sound-generating condition, the content subject of the predetermined preferential order rule is altered. This altering is conducted so that the above-mentioned musical tone-generating channels with the successive strike relation are preferentially selected, and are assigned with new musical tones, according to the assigning order based on the predetermined preferential order rule at least among musical tone-generating channels in the sound-generating condition. Under the altered content of the preferential order rule, a musical tone-generating channel is selected and a new musical tone is assigned based on the predetermined preferential order rule.

To attain the above object, the third invention provides an assigning device of an electronicc musical instrument which selects a musical tone-generating channel to assign a new musical tone, basically comprising:

(a) successive-strike detecting means for detecting musical tone-generating channels with a successive strike relation, from among the channels which are in sound-generating condition;

(b) altering means for altering the content subject of a predetermined preferential order rule so that a musical tone-generating channel that is detected by the detecting means and has the successive strike relation is preferentially selected among the musical tone-generating channels in the sound-generating condition to be assigned with a new musical tone, according to the assigning order based on the predetermined preferential order rule; and (c) channel selecting means for selecting preferentially: at first, in case that a musical tone-generating channel in sound-generation finished condition is existing, the musical tone-generating channel in sound-generation finished condition; and next, in case that a musical tone-generating channel in sound-generation finished condition is not existing and all musical tone-generating channels are in sound generating condition, a musical tone-generating channel based on the predetermined preferential order rule under the content subject of the predetermined preferential order rule and to be altered by the altering means, to assign a new musical tone.

As to the musical tone-generating channels with the successive strike relation detected from among the channels being musical sound-generating condition, the content subject of the predetermined preferential order rule is altered. This altering is conducted so that the above-mentioned musical tone-generating channels with the successive strike relation are preferentially selected, and are assigned with new musical tones, according to the assigning order based on the predetermined preferential order rule among musical tone-generating channels in the sound-generating condition. Thus, at first, in case that a musical tone-generating channel in sound-generation finished condition is existing, the musical tone-generating channel in sound-generation finished condition is selected and a new musical tone is assigned; next, in case that a musical tone-generating channel in sound-generation finished condition is not existing and all musical tone-generating channels are in sound generating condition, a musical tone-generating channel is selected and a new musical tone is assigned based on the predetermined preferential order rule under the altered content of the predetermined preferential order rule.

To attain the above object, the forth invention provides an assigning device of an electronic musical instrument which selects a musical tone-generating channel to assign a new musical tone, basically comprising:

(a) successive-strike detecting means for detecting musical tone-generating channels with a successive strike relation, from among the channels which are in sound-generating condition;

(b) altering means for altering the content subject of a predetermined preferential order rule so that a musical tone-generating channel that is detected by the detecting means and has the successive strike relation is preferentially selected among the musical tone-generating channels in the sound-generating condition to be assigned with a new musical tone, according to the assigning order based on the predetermined preferential order rule; and (c) channel selecting means for selecting preferentially: in case that a musical tone-generating channel, which is subject to be assigned based on preliminarily determined selecting order of musical tone-generating channels for assigning a new musical tone, is in sound-generation finished condition, the musical tone-generating channel in sound-generation finished condition; and next, in case a musical tone-generating channel, which is subject to be assigned based on preliminarily determined selecting order of musical tone-generating channels for assigning a new musical tone, is not in sound-generation finished condition, a musical tone-generating channel based on the predetermined preferential order rule under the content subject to the predetermined preferential order rule and to be altered by the altering means, to assign a new musical tone.

As to the musical tone-generating channels with the successive strike relation detected from among the channels being musical sound-generating condition, the content subject of the predetermined preferential order rule is altered. This altering is conducted so that the above-mentioned musical tone-generating channels with the successive strike relation are preferentially selected, and are assigned with new musical tones, according to the assigning order based on the predetermined preferential order rule among musical tone-generating channels in the sound-generating condition. Thus, in case that a musical tone-generating channel, which is subject to be assigned based on preliminarily determined selecting order of musical tone-generating channels for assigning a new musical tone, is in sound-generation finished condition, the musical tone-generating channel in sound-generation finished condition is selected and a new musical tone is assigned; next, in case a musical tone-generating channel, subject to be assigned, is not in sound-generation finished condition, a musical tone-generating channel is selected and a new musical tone is assigned based on the predetermined preferential order rule under the altered content of the predetermined preferential order rule.

As explained above, according to the present invention, on determining preliminarily the preferential order for assignment of a new musical tone to a musical tone-generating channel, and more generally, determining a musical tone-generating channel for assigning a new musical tone of successive strike, a channel which is not generating sound on the whole is determined to be selected at first, followed by a channel having the sound-generating condition and successive strike relation, so that incongruous feeling is minimized in the musical performance.

Following is an example of the predetermined preferential order rule:

1. Using the sound generation volume of a musical tone-generating channel as the content subject of the predetermined preferential order rule, priority is given to a musical tone-generating channel having smaller sound generation volume.
2. Using the features of sound-generating condition including note-on and note-off of a musical tone-generating channel as the content subject of the predetermined preferential order rule, priority is given to musical tone-generating channels at least in the note-off sound-generating condition over those in the note-on sound-generating condition.
3. Using the features of sound-generating condition including note-on and note-off of a musical tone-generating channel and the sound generation volume of a musical tone-generating channel as the content subject of the predetermined preferential order rule, priority is given to musical tone-generating channels at least in the note-off sound-generating condition over those in the note-on sound-generating condition, and among the musical tone-generating channels at least in the note-off sound-generating condition, to a musical tone-generating channel having smaller generation volume of musical tones.
4. Using the features of sound-generating and sound generation-finished conditions of a musical tone-generating channel as the content subject of the predetermined preferential order rule, priority is given to a musical tone-generating channel in the sound-generation-finished condition over that in the sound-generating condition.

The above-described predetermined preferential order rule may also consider the sound-generating conditions of damper and/or sostenuto as the content subject to the predetermined preferential order rule.

On the other hand, to attain the above object, the other inventions provide an assigning device of an electronic musical instrument which selects a musical-tone generating channel to assign a new musical tone, comprising:

(a) successive-strike detecting means for detecting musical tone-generating channels with a successive strike relation, from among the channels which are in sound-generating condition;

(b) channel selecting means for selecting preferentially a musical tone-generating channel that is detected by the detecting means and has the successive strike relation, over those in no successive strike relation, and also a musical tone-generating channel in sound-generation finished condition over those in the successive strike relation to assign a new musical tone.

Further, it is comprising:

(a) successive-strike detecting means for detecting musical tone-generating channels with a successive strike relation, from among the channels which are in sound-generating condition;

(b) channel selecting means for selecting preferentially: at first, in case that a musical tone-generating channel in sound-generation finished condition is existing, the musical tone-generating channel in sound-generation finished condition; and next, in case that a musical tone-generating channel in sound-generation finished condition is not existing and all musical tone-generating channels are in sound generating condition, a musical tone-generating channel detected by the successive strike detecting means, to assign a new musical tone.

In addition to the above, it is comprising:

(a) successive-strike detecting means for detecting musical tone-generating channels with a successive strike relation, from among the channels which are in sound-generating condition;

(b) channel selecting means for selecting preferentially: in case that a musical tone-generating channel, which is subject to be assigned based on preliminarily determined selecting order of musical tone-generating channels for assigning a new musical tone, is in sound-generation finished condition, the musical tone-generating channel in sound-generation finished condition; and next, in case a musical tone-generating channel, which is subject to be assigned based on preliminarily determined selecting order of musical tone-generating channels for assigning a new musical tone, is not in sound-generation finished condition, a musical tone-generating channel detected by the successive strike detecting means, to assign a new musical tone.

BRIEF DESCRIPTION OF THE DRAWINGS

FIG. 1 through FIG. 18 show a first embodiment of an assigning device of an electronic musical instrument according to the present invention.

FIG. 1 is a schematic block diagram.

FIG. 2 through FIG. 5 show a constructional diagrams of note map, envelope management map, task management map and musical tone-generating channel management map, respectively.

FIGS. 6–12, 13(*a*), 13(*b*), 14–17 show flow chart of reset routine, event wait monitor call routine, event occurence monitor call routine, timer interrupt processing routine, key data receive interrupt processing routine, key data receive task, main assigner task, sound generation task, preassigner task, successive strike processing routine, envelope task and operator task, respectively.

FIG. 18 shows a flow chart of successive strike processing routine for explanation of a modified embodiment.

DESCRIPTION OF THE PREFERRED EMBODIMENTS

First Embodiment

Now, an embodiment of an assigning device of an electronic musical instrument according to the present invention will be described with reference to the accompanying drawings, for the case where the device is applied to an electronic musical instrument which generates percussive musical tones.

Figure 1:
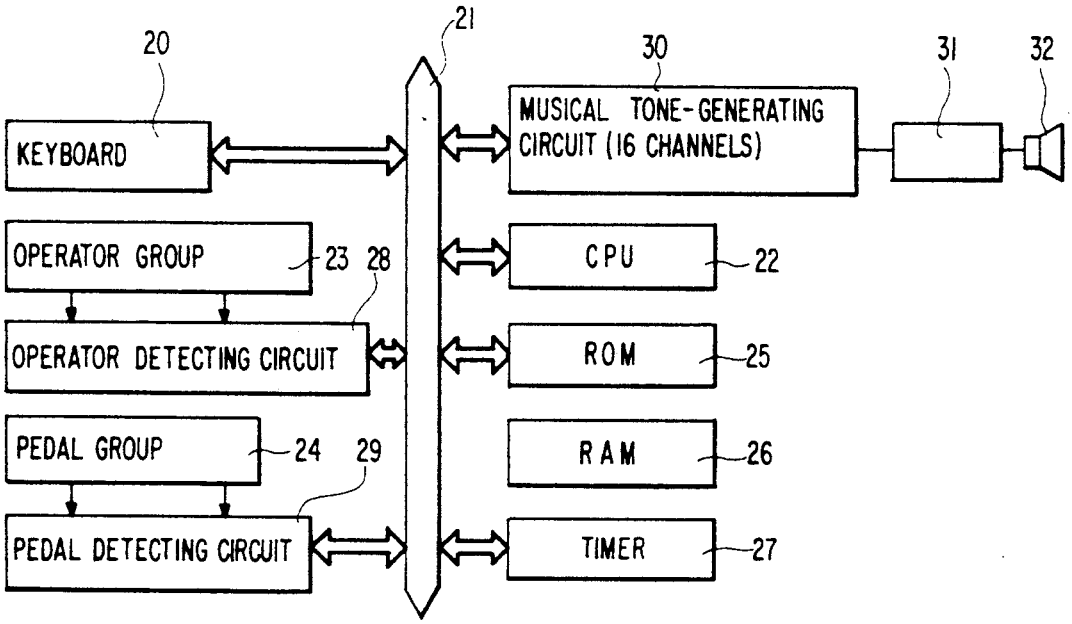

Referring to FIG. 1, a keyboard 20 comprises keys and a key operation detecting circuit which detects an operated key, generates key data corresponding to the detected key, and interrupts a CPU 22 through a bus 21. An operator group 23 is composed of a plurality of operators to select timbre. A pedal group 24 includes a damper pedal and a sostenuto pedal. In a ROM 25 are preliminarily stored programs to be executed in the CPU 22, and data and tables needed for each processing. In a RAM 26 is set a working area including various kinds of registers needed for executing programs. A timer 27 performs timer interruption for the CPU 22 at a predetermined time interval (1 msec.).

The CPU 22 executes a predetermined program, receives key data in response to an interruption from the keyboard 20, and writes the key data into the corresponding register of the RAM 26. Also in response to a timer interruption from the timer 27, the CPU 22 detects the operation setting state of operator group 23 and the operating state of pedal group 24 at a predetermined time interval, by controlling each operator detecting circuit 28 and pedal detecting circuit 29, and writes the detected states into the corresponding register of RAM 26 as operator data and pedal data. Furthermore, based on these key, operator and pedal data written in the RAM 26, the CPU 22 executes a predetermined program to control a musical tone-generating circuit 30 which has sixteen musical tone-generating channels. The musical tone-generating circuit 30 generates a desired musical tone signal under the control of CPU 22, transmits the signal to a speaker 32 through an amplifier 31, thus generating a musical tone.

Each musical tone-generating channel generates a musical tone signal, based on a musical tone-generating instruction and related musical tone-generating parameters given from the CPU 22, and changes the generated musical tone signal with time lapse. Each musical tone-generating channel interpolates the envelope level on the basis of a target value for the next envelope level and a change rate of the envelope level in a specified time period, both given from the CPU 22, thereby generating a smooth envelope to control the amplitude of a musical tone signal. It also damps the envelope level at a predetermined fast damping rate by giving a fast damping instruction and, when the envelope level becomes "0", accumulates a musical tone-generating channel number in the fast damping finish FIFO provided in the musical tone-generating circuit 30.

Now, various maps including a note map set in the predetermined area of RAM 26 are described with reference to FIG. 2 through FIG. 5, which show a part of the maps.

NOTE MAP (FIG. 2)

The following information is stored for each of the note numbers from "0" to "127" which represent the sound pitch of a musical tone.

(1) Note status: "1" for note-on, and "0" for note-off
(2) Sostenuto status: "1" for sostenuto-on, and "0" for sostenuto-off

TASK MANAGEMENT MAP (FIG. 4)

The following information is stored for each of the task numbers from "1" to "7" which represent kinds of tasks: the task number "1" for a key data receive task, "2" for a main assigner task, "3" for a sound generation task, "4" for a preassigner task, "5" for an envelope task, "6" for a pedal task, and "7" for an operator task. A task with smaller task number has higher priority.

(1) Timer processing request flag: Indicates by "1" that a timer processing is needed.
(2) Status: The state that the task is being run is indicated by "0", ready by "1", and wait by "2".
(3) Wait event value: Kind of wait event with wait status is indicated.
(4) Event occurring flag: Indicates by "1" for each event that the event is occurred in a task.

MUSICAL TONE-GENERATING CHANNEL MANAGEMENT MAP (FIG. 5)

The following information is stored for each of the channel numbers from "0" to "15" which represent sixteen musical tone-generating channels.

(1) Sound generation volume: The sound generation volume of a musical tone being generated is indicated by "OOOOH" to "FFFFH".
(2) Truncate inhibit flag: Indicates by "1" that assigning a new musical tone is inhibited.
(3) Fast damping flag: Indicates by "1" that the previous musical tone is decaying rapidly.
(4) Process wait flag 1: Indicates by "1" that the sound generation task is waiting for the first processing.
(5) Process wait flag 2: Indicates by "1" that the sound generation task is waiting for the second processing.
(6) Process wait flag 3: Indicates by "1" that the sound generation task is waiting for the third processing.
(7) Note number: The sound pitch of a musical tone is indicated.
(8) Velocity: The velocity of a musical tone is indicated.
(9) Group of musical tone-generating parameters: The value of each parameter relating to a musical tone generation is indicated.

ENVELOPE MANAGEMENT MAP (FIG. 3)

The following information is stored for each of the envelope channel numbers from "0" to "15" which represent sixteen envelope channels corresponding to musical tone-generating channels.

(1) Envelope level: The envelope level is indicated by "OOOOH" to "FFFFH".
(2) Target value: The target for the next envelope level is indicated by "OOOOH" to "FFFFH".
(3) Rate: Change of an envelope level in a specified time (5 msec) is indicated. More specifically, the indication consists of a positive or negative sign bit and data bits which shows an absolute value by "OOOOH" to "FFFFH".
(4) Phase number: The current phase number (progress from the beginning of musical tone generation) is shown.
(5) Truncate inhibit phase number: The last phase number for which an assignment of a new musical tone is inhibited is shown.
(6) Group of envelope generating parameters: The value of each parameter relating to an envelope generation of a musical tone is shown.

Next, the basic operation of an electronic musical instrument having the above-mentioned construction is described referring to the flow charts shown in FIG. 6 through FIG. 17. The following variables are used in these flow charts:

NSTK Request source task number: The task number of the task requesting a monitor-call.

NSET Request source event value: The kind of an event to be processed next in the task requesting monitor-call.

NDTK Request destination task number: The task number of a task to be executed next.

NDET Request destination event value: The kind of an event to be processed in the task which is to be executed next.

IEDF Initial setting end flag: Completion of initial setting for all tasks is indicated by "1".

TCTN Timer interruption target number: The target task number for timer interruption.

TCNE[N] "N"th task timer counter value: The value of the timer counter for the task of task number N.

TCND[N] "N"th task time interval: The time interval at which a timer event is issued to the task of task number N.

TCNE[TCTN] "TCTN"th task timer counter value: The value of the task timer counter for the task whose task number is the timer interruption target number TCTN.

TCND[TCTN] "TCTN"th task time interval: The time interval at which a timer event is issued to the task whose task number is the timer interruption target number TCTN.

Key data receive task

NTNM Note number: The sound pitch of key data.

NTST Note status: key data based on key depression is indicated by "1", and that based on key release by "0".

NTVL Velocity: The velocity of key data based on the key depression.

Main assigner task

MASS[N] "N"th assigning order musical tone-generating channel number: The musical tone-generating channel number which is the "N"th in the assigning order.

TASN Target assign order: The assign order number in the assignment turn.

MAEF Main assigner processing flag: Indicates by "1" that a new assigning process was conducted in the main assigner task.

MASS[TASN] Musical tone-generating channel number of the target assign order TASN: Musical tone-generating channel number of the target assign order TASN which is in the assignment turn.

GACN Number of assignable musical tone-generating channels: The number of musical tone-generating channels available for an assignment.

Sound generation task

GCTN Musical tone-generating channel number for sound generation processing: The number of the musical tone-generating channel subject to a sound generation processing.

TDNF Fast damping not finish flag: Indicates by "1" that a musical tone-generating channel is decaying rapidly.

Preassigner task

GN Musical tone-generating channel number

PLEV[GN] Preassigner sound generation volume of musical tone-generating channel number GN N Preassigning order PASS[N] "N"th preassigning order musical tone-generating channel number: The musical tone-generating channel number which is the "N"th in the preassigning order.

PACN Number of preassigner assignable musical tone-generating channels: The number of musical tone-generating channels available for an assignment in the preassigner task.

PCTN Successive-strike processing target number

RSEF Successive-strike detecting flag: Indicates by "1" the detection of successive strikes.

SCTN Successive-strike comparison target number

PASS[PCTN] Musical tone-generating channel number of successive-strike processing target number PCTN: The musical tone-generating channel number whose preassigning order number is a successive-strike processing target number PCTN.

PLEV[PCTN] Preassigner sound generation volume of successive-strike processing target number PCTN: The sound generation volume by preassigner of a musical tone-generating channel whose number is a successive-strike processing target number PCTN.

PASS[SCTN] Musical tone-generating channel number of successive-strike comparison target number SCTN: The musical tone-generating channel number whose preassigning order number is a successive-strike comparison target number SCTN.

PLEV[SCTN] Preassigner sound generation volume of successive-strike comparison target number SCTN: The sound generation volume by preassigner of a musical tone-generating channel whose number is a successive-strike comparison target number SCTN.

Envelope task

ECTN Envelope processing target number

ENNM Envelope processing target note number

Pedal task

DMPV Damper value

In this embodiment, each task (key data receive task, main assigner task, sound generation task, preassigner task, envelope task, pedal task and operator task) is processed in a multi-tasking, and the priority processing among different tasks is executed by using a monitor program. Here, the monitor program has a reset routine, event wait monitor call routine, event occurrence monitor call routine, timer interrupt processing routine, and key data receive interrupt processing routine.

The monitor program is now described in the following with reference to the flow charts of FIGS. 6 through 10.

Figures 2, 3, 6:
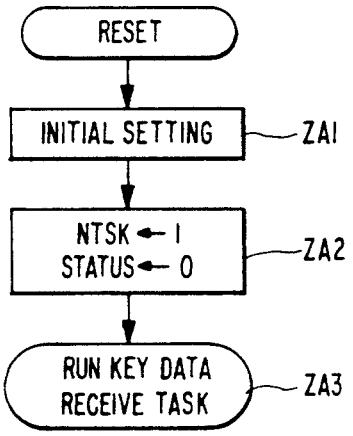

Reset routine (FIG. 6)

The reset routine is executed when an reset instruction is given, for example, at the time of power on. The processing in the steps ZA1 to ZA3 are as follows:

[ZA1] The status of each task number in the task management map is set to "1: ready", and the timer processing request flag, wait event value and event occurring flag are set to "0". The initial setting is carried out: the initial setting end flag IEDF is set to "0: initial setting not end".

[ZA2] The request source task number NSTK is updated to "1: key data receive task", and the status of task number "1: key data receive task" in the task management map is set to "0: run".

[ZA3] The key data receive task is executed.

Figure 7:
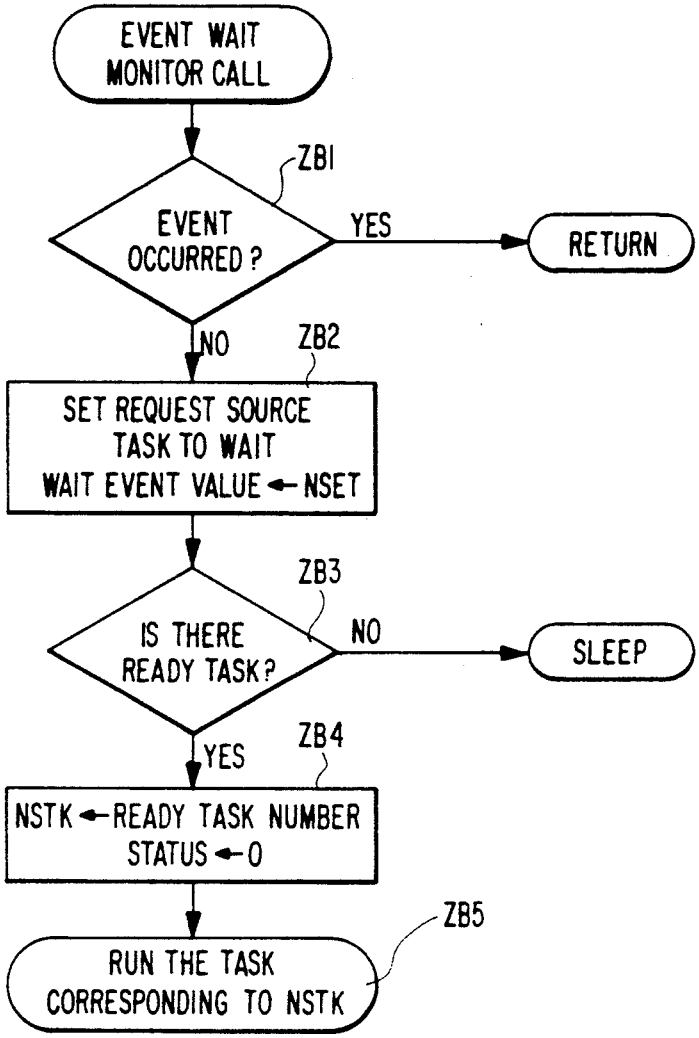

Event wait monitor call routine (FIG. 7)

This routine is executed when the task being run request for an event wait monitor call. The processing in each step of ZB1 through ZB5 is as follows:

[ZB1] As for the task number corresponding to the request source task number NSTK in the task management map, it is determined whether or not either of the event occurring flags corresponding to a bit "1" in binary expression of the request source event value NSET is "1: event occurrence". If either of the corresponding event occurring flags is "1: event occurrence", the process is returned to the task which requested an event wait monitor call.

When the request source event value NSET is "1", the above determination is carried out for the first event occurring flag. When the NSET is "2", the determination is carried out for the second event occurring flag. When the NSET is "3", the determination is carried out for the first and second event occurring flags.

[ZB2] If neither of event occurring flags is "1" in the step ZB1, indicating no event occurrence, the status of the task number corresponding to the request source task number NSTK in the task management map is set to "2: wait", and the wait event value is set to the request source event value NSET. To provide for the resuming of processing, the content of the register being used for the request source task is saved in the stack area for suspending the processing (this step is hereinafter referred to simply as request source task suspension process).

[ZB3] The task management map is searched sequentially in the order of task numbers for a "ready" task whose preferential order number is smaller than that of the task executing an event wait monitor call and whose corresponding status is "1: ready", When there is no "ready" task with the status of "1: ready", the request source task number NSTK is set to "8" which indicates sleep. From the sleep, the timer interrupt processing routine or key data receive interrupt processing routine is started, as will be described later, based on the hardware interrupt from the timer 27 or the key operation detecting circuit.

[ZB4] When "ready" task of the highest priority is searched out in the step ZB3, the request source task number NSTK is updated to the task number of this highest priority "ready" task, and the status of the task number of the highest priority "ready" task in the task management map is set to "0: run".

[ZB5] The task corresponding to the request source task number NSTK is executed. Prior to this execution, the data saved in the stack area in the request source task suspension process is returned to the register to resume the processing (this step is hereinafter referred to simply as resuming process).

Figure 8:
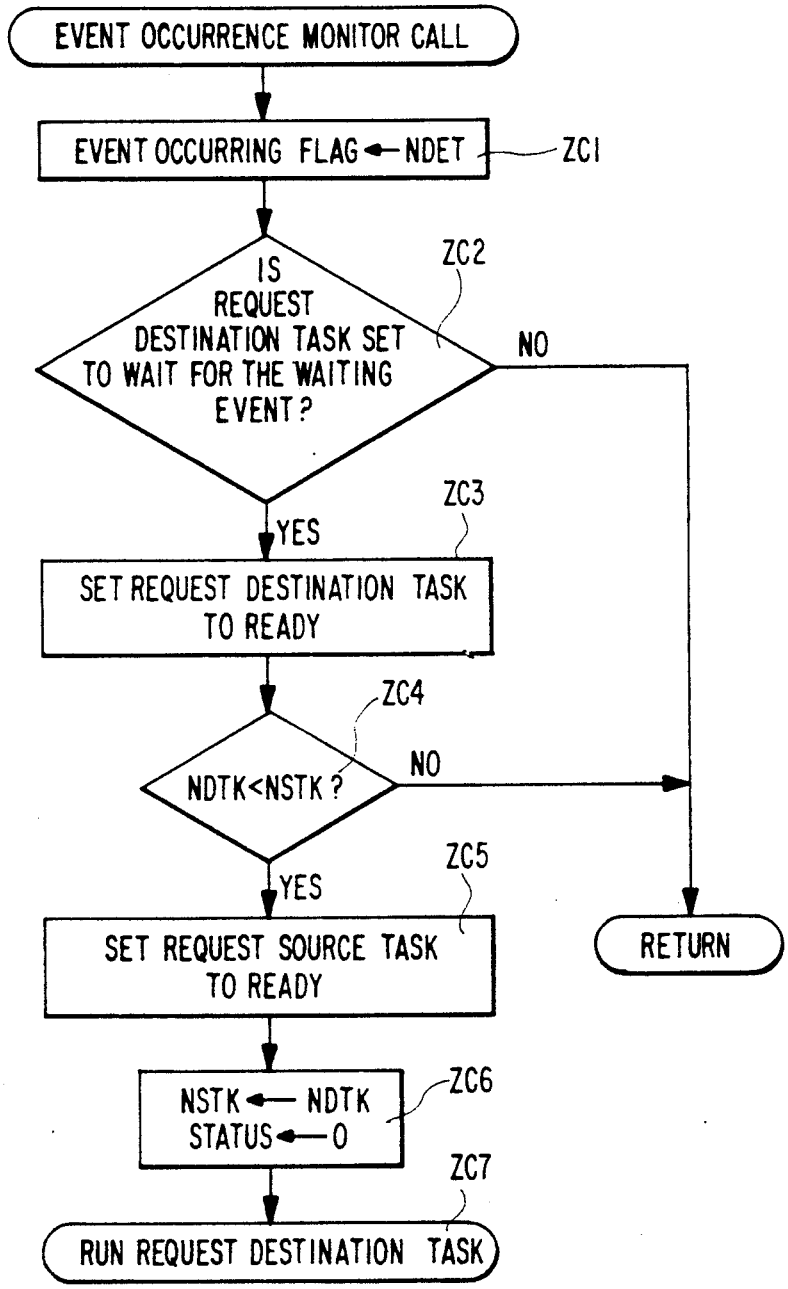

Event occurrence monitor call routine (FIG. 8)

This routine is executed when a task being run executes an event occurrence monitor call. The processing in each step of ZC1 through ZC7 is as follows:

[ZC1] For a task number corresponding to the request destination task number NDTK in the task management map, the event occuring flag corresponding to a bit "1" in the binary expression of the request destination event value NDET is set to "1". For example, when the request destination event value NDET is "1", the first event occurring flag is set to "1". When the request destination event value NDET is "2", the second event occurring flag is set to "1".

[ZC2] It is determined whether or not the status of the task number corresponding to the request destination task number NDTK in the task management map is "2: wait", with the wait event value corresponding to the request destination event value NDET. If the status is not "2: wait" or the wait event value does not correspond to the request destination event value NDET, the process returns to the task which executed the aforementioned monitor call.

The above decision on correspondence between a wait event value and the request destination event value NDET is made by determining whether or not either of the bits in the binary expression of the request destination event value NDET which corresponds to a bit "1" in the binary expression of the wait event value is "1". For example, if the wait event value is "1", it is decided that there is a correspondence when the first bit of the request destination event value NDET is "1". If the wait event value is "2", it is decided that there is a correspondence when the second bit of the request destination event value NDET is "1". When the wait event value is "3", it is decided that there is a correspondence when the first or second bit of the request destination event value NDET is "1".

[ZC3] In the decision in the step ZC2, if the status of the appropriate task number is "2: wait" and the wait event value corresponds to the request destination event value NDET, this status is set to "1: ready".

[ZC4] Whether or not the request destination task number NDTK is smaller than the request source task number NSTK is determined to judge whether or not the preferential order of the request destination task is higher than that of the request source task. When the request destination task number NDTK is not smaller than the request source task number NSTK so that the request destination task has lower priority, the process returns to the task which executed this monitor call.

[ZC5] In the decision in the step ZC4, if the request destination task number NDTK is smaller than the request source task number NSTK so that the request destination task has a higher priority, the status of the task number corresponding to the request source task number NSTK in the task management map is set to "1: ready", and the request source task suspension processing is executed to provide for resuming the process.

[ZC6] The request source task number NSTK is updated to the request destination task number NDTK, and the status of the task number corresponding to the request destination task number NDTK in the task management map is set to "0: run".

[ZC7] The task of the number corresponding to the request destination task number NDTK is executed. The resuming process is executed prior to the task execution.

Figure 9:
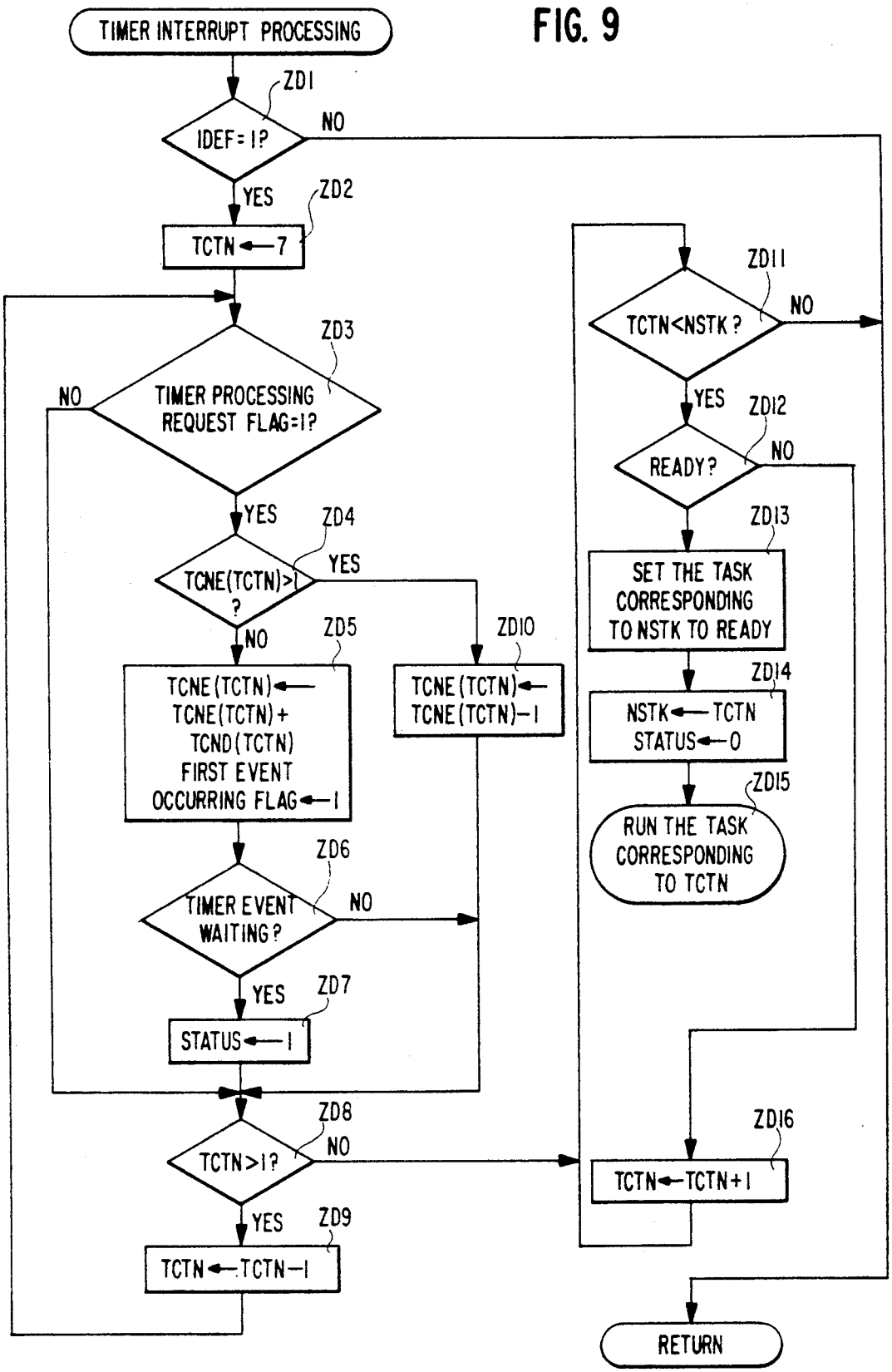

Timer interrupt processing routine (FIG. 9)

This routine executes the following processing: When a timer interrupt is given from the timer 27, the timer counter corresponding to each task is investigated first. When the timer counter value is more than "1", the value is decreased by "1". When the value is not more than "1", the first event occurring flag of the task number of the appropriate task in the task management map is set to "1: event occurrence" and, when the status of this task number is "2: wait", the status is set to "1: ready". Next, the tasks are investigated in the order of the higher priority to judge whether or not each task should be executed or not, and the first task that meets the requirement is executed. The processing in each of the steps ZD1 through ZD16 is described in the followings.

[ZD1] It is determined whether or not the initial setting end flag IEDF is "1: initial setting end". When the IEDF is not "1", an initial setting is not yet completed for all tasks. Therefore, a timer interrupt processing is terminated, and the processing executed before the timer interruption is resumed. When the IEDF is "1", it means that the initial setting described later has been completed for all tasks. Therefore, the process advances to the next step ZD2.

[ZD2] The timer interrupt processing target number TCTN, which represents the task number subject to the timer interrupt processing, is set to "7".

[ZD3] It is determined whether or not the timer processing request flag of the task number corresponding to the timer interrupt processing target number TCTN in the task management map is "1: requested". When the timer processing request flag is not "1", the process skips to step ZD8.

[ZD4] In step ZD3, when the timer processing request flag for the appropriate task number is "1: requested", it is judged whether or not the "TCTN"th task timer counter value TCNE(TCTN) is more than "1". If the TCNE(TCTN) value exceeds "1", the process skips to step ZD10.

[ZD5] In step ZD4, when the "TCTN"th task timer counter value TCNE(TCTN) does not exceed "1", the "TCTN"th task time interval TCND(TCTN) is added to the TCNE(TCTN) value, and the sum is set as a new "TCTN"th task timer counter value TCNE(TCTN). Then, the first event occurring flag of the task number corresponding to the timer interrupt processing target number TCTN in the task management map is set to "1: event occurrence".

[ZD6] It is judged whether or not the status of the task number corresponding to the timer interrupt processing target number TCTN in the task management map is "2: wait", and the first bit of the wait event value of the task number in the binary expression is "1" (for example, the wait event value is "1" or "3"). When the status is not "2: wait", or the first bit of the wait event value in the binary expression is not "1", the process skips to step ZD8.

[ZD7] In the judgment of step ZD6, when the status is "2: wait" and the first bit of the wait event value in the binary expression is "1", the status of the task number corresponding to the timer interrupt processing target number TCTN in the task management map is set to "1: ready".

[ZD8] It is judged whether or not the timer interrupt processing target number TCTN exceeds "1". When the TCTN does not exceed "1", it means that the setting for event occurring flag has been completed, and the process skips to step ZD11.

[ZD9] In the judgment of step ZD8, when the timer interrupt processing target number TCTN exceeds "1", the TCTN is decreased by "1", and the process returns to step ZD3.

[ZD10] In the judgment of step ZD4, when the "TCTN"th task timer counter value TCNE(TCTN) exceeds "1", the TCNE (TCTN) value is decreased by "1", and the process skips to step ZD8.

[ZD11] It is judged whether or not the timer interrupt processing target number TCTN is smaller than the request source task number NSTK which represents the processing before occurring the timer interruption in the present routine. When the TCTN is not smaller than the NSTK, the preferential order of the task being executed at the time of timer interrupt occurrence is higher that of the task corresponding to the timer interrupt processing target number TCTN. Accordingly, the timer interrupt processing is terminated, and the original task processing is resumed.

[ZD12] In the judgment of step ZD11, when the TCTN is smaller than the NSTK, it is judged whether or not the status of the task number corresponding to the timer interrupt processing target number TCTN in the task management map is "1: ready". If this status is not "1", the process skips to step ZD16.

[ZD13] In the judgement of step ZD12, if the status is "1: ready", the status of the task number corresponding to the request source task number NSTK in the task management map is set to "1: ready", and the task corresponding to the request source task number NSTK is suspended to prepare for resuming the processing.

[ZD14] The request source task number NSTK is updated to the timer interrupt processing target number TCTN, and the status of the task number corresponding to the TCTN in the task management map is set to "0: run".

[ZD15] A timer event is generated. In other words, the task of the number corresponding to the timer interrupt processing target number TCTN is executed. Prior to this task execution, the processing for resuming the task is executed.

[ZD16] In the judgement of step ZD12, when the status is not "1: ready", the timer interrupt processing target number TCTN is increased by "1", and the process returns to step ZD11.

Figure 10:
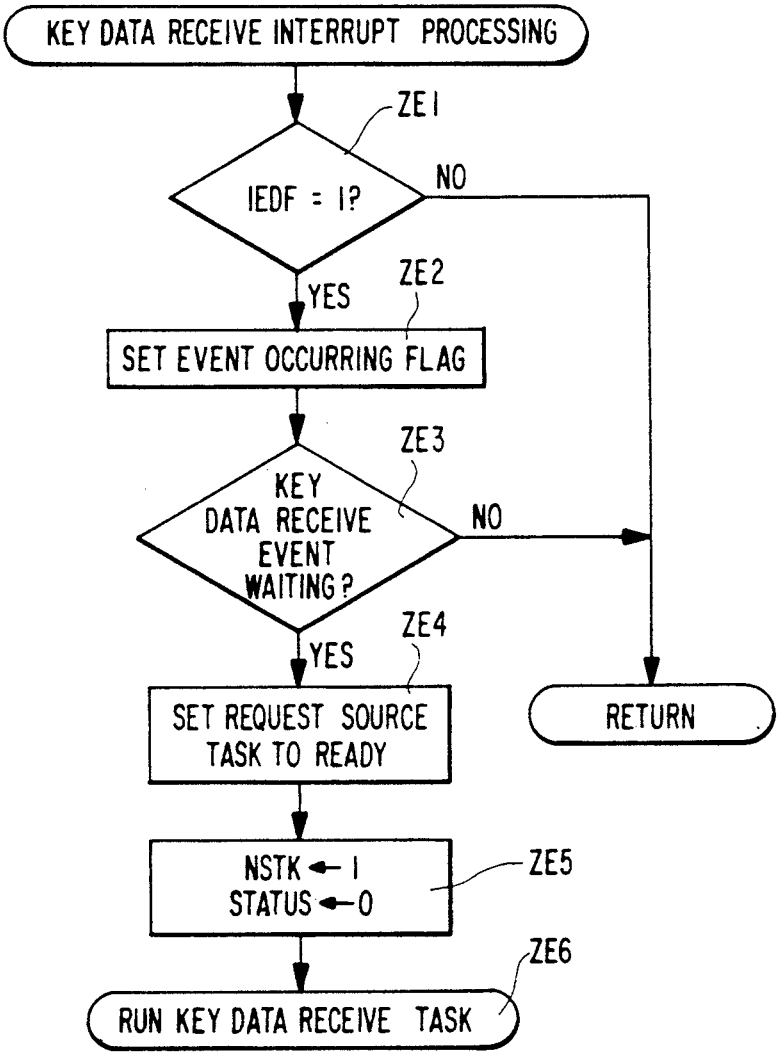

Key data receive interrupt processing routine (FIG. 10)

At interruption from the key operation detecting circuit, this routine is executed to generate a key data receive event. The processing in each of the steps ZE1 through ZE6 is described in the followings.

[ZE1] It is judged whether or not the initial setting end flag IEDF is "1: completion". When the IEDF is not "1", it means that the initial setting is not yet completed for all tasks. Therefore, the key data receive interrupt processing is terminated, and the processing being executed before an occurrence of key data receive interrupt is resumed.

[ZE2] In the judgment of step ZE1, when the IEDF is "1: completion," the first event occurring flag of the task number "1: key data receive task" in the task management map is set to "1: occurrence".

[ZE3] It is judged whether or not the status of the task number "1: key data receive task" in the task management map is "2: wait", and the wait event value is "1: key data receive event". If this status is not "2: wait", or the wait event value is not "1: key data receive event", the key data receive interrupt processing is terminated, and the processing being executed before an occurrence of key data receive interrupt is resumed.

[ZE4] In the judgment of step ZE3, when the status is "2" and the wait event value is "1" so that a key data receive event is waited for, it is judged whether or not the request source task number NSTK, which represents the processing being executed before an occurrence of the key data receive interrupt in the present routine, is smaller than "8". When the NSTK is smaller than "8", the status of the task number corresponding to the NSTK in the task management map is set to "1: ready", and the task being executed before an occurrence of the timer interrupt is suspended to prepare for resuming the processing. When the NSTK is not smaller than "8", no special processing is required.

[ZE5] The request source task number NSTK is updated to the task number "1: key data receive task", and the status of the task number "1: key data receive task" in the task management map is set to "0: run".

[ZE6] A key data receive event is generated. In other words, the key data receive task is executed. Prior to this task execution, the processing for resuming the key data receive task is executed.

Now, various tasks are explained in the order of a key data receive task, main assigner task, sound generation task, preassigner task, envelope task, pedal task and operator task. When a reset by turning on power or other operation, each task starts the processing from the initial step, or for example, from step A1 in the case of the key data receive task described in the following paragraph. When the processing of a certain task is resumed after suspending, the task is resumed from the point where the processing was suspended. For example, it is assumed that after the event wait monitor call in the step A2 of key data receive task, a suspension is executed instead of an event generation based on the judgment in the event wait monitor call routine. In this state, when the key data receive interrupt is occurred, and a resuming process is executed in the key data receive interrupt routine, the processing is resumed from step A3 which follows the event wait monitor call of step A2.

Figure 11:
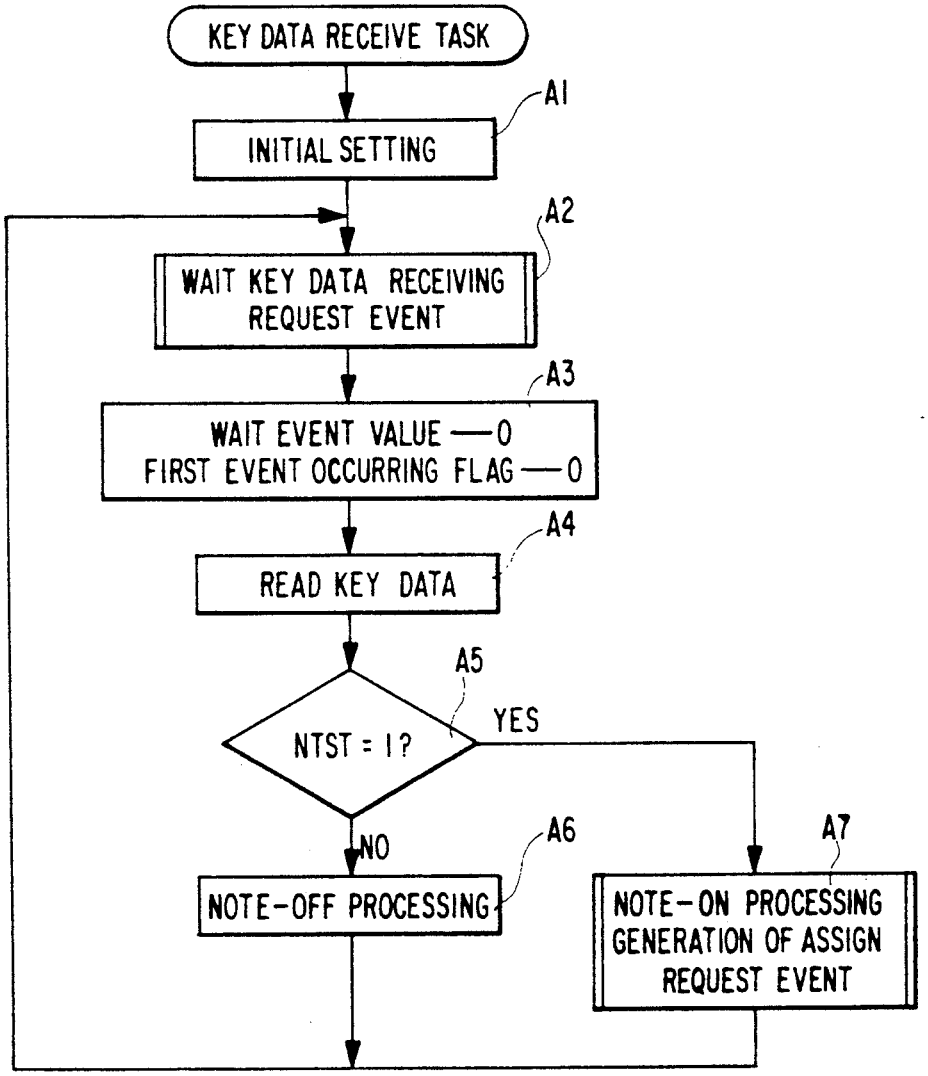

Key data receive task (FIG. 11)

When key data receive event occurs, this task reads key data from the key operation detecting circuit, and generates an assign request event. A processing in each of steps A1 through A7 is described in the followings.

[A1] The note map is cleared, and variables and other values used by this task are set to initial values.

[A2] The request source event value NSET is set to "1" to execute an event wait monitor call. When a key data receive event occurred, the process advances to step A3.

[A3] The first event occurring flag and wait event value of the task number "1: key data receive task" in the task management map are set to "0".

[A4] A key data is read from the key operation detecting circuit, and the note number, note status and note velocity of this key data are set as the corresponding note number NTNM, note status NTST and velocity NTVL, respectively.

[A5] It is judged whether or not the note status NTST is "1: key depress". When the NTST is not "1", the process advances to the next step A6. When the NTST is "1", the process skips to step A7.

[A6] Key release processing
The note status of the note number corresponding to the note number NTNM in the note map is set to "0", and the process returns to step A2.

[A7] Key depress processing
First, the note status of the note number corresponding to the note number NTNM in the note map is set to "1". Next, an assign request event is generated. In other words, the request destination task number NDTK is set to "2: main assigner task", and the request destination event value NDET to "1", to execute an event occurrence monitor call. Then, the process returns to step A2.

Figure 12:
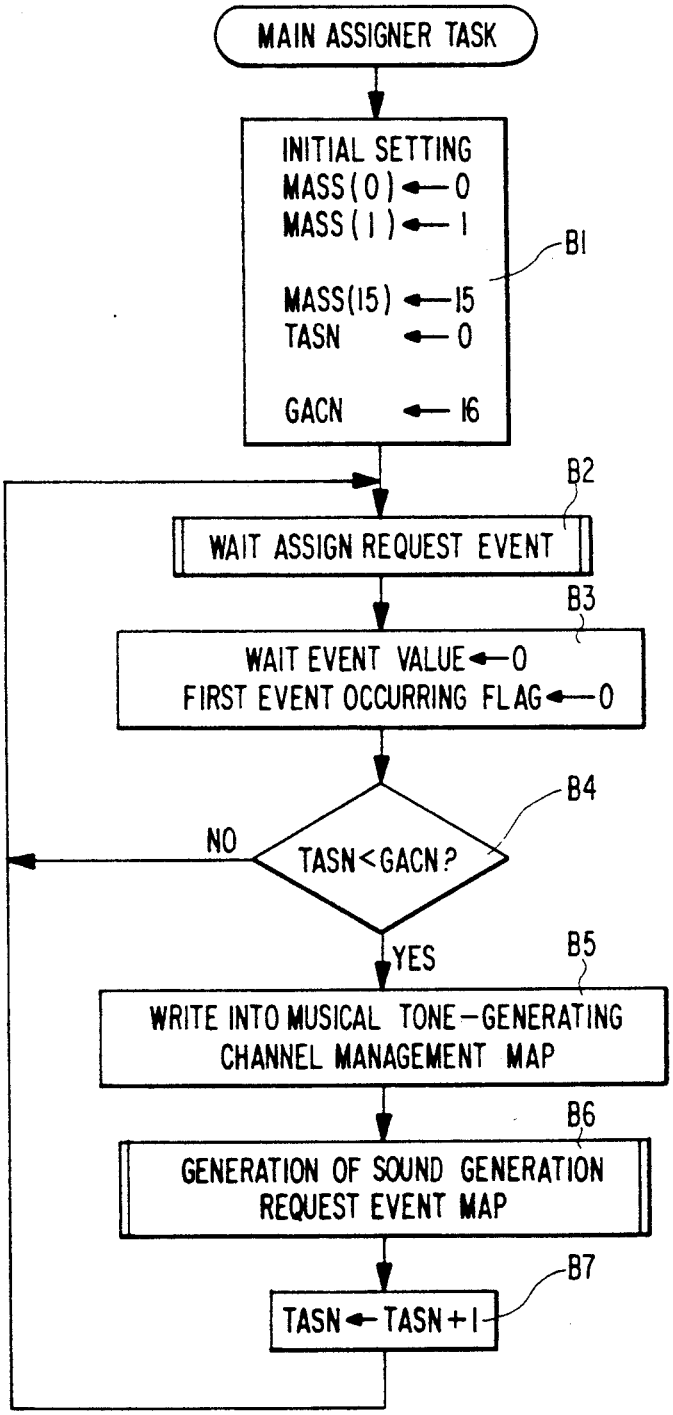

Main assigner task (FIG. 12)

In this task, when an assign request event occurs, the note number NTNM and other data are written in the predetermined area of the musical tone-generating channel management map according to the assigning order set by the preassigner task described later, thereby generating a sound generation request event. Processing in each of steps B1 through B7 is described in the followings.

[B1] Musical tone-generating channel management map is cleared, and variables and other values to be used by this task are set to initial values. The "N"th assign order musical tone-generating channel number MASS[N] (N=0, 1, - - - , 15) is set to "N (=0, 1, - - - , 15)", in each corresponding relation. Furthermore, the target assign order TASN is set to "0", and the number of assignable musical tone-generating channels GACN is set to the maximum "16".

[B2] The request source event value NSET is set to "1" to execute an event wait monitor call. When an assign request event occurs, the process advances to step B3.

[B3] The wait event value and the first event occurring flag of task number "2: main assigner task" in the task management map are set to "0".

[B4] It is judged whether or not the target assign order TASN is smaller than the number of assignable musical tone-generating channels GACN. When the TASN is not smaller than GACN, indicating that there is no assignable channel, the process returns to step B2.

[B5] In the judgment of step B4, when the target assign order TASN is smaller than the number of assignable musical tone-generating channels GACN, the process wait flags 1, 2 and 3 of the musical tone-generating channel number corresponding to the musical tone-generating channel number MASS[TASN] of the target assign order TASN in the musical tone-generating channel management map are set to "1: process waiting", the note number to note number NTNM, the note status to "1", and the velocity to velocity NTVL. The main-assigner processing flag MAEF is set to "1: main-assigner processing".

[B6] A sound generation request event is generated. In other words, the request destination task number NDTK is set to "3: sound generation task", and the request destination event value NDET to "2", to execute an event occurrence monitor call.

[B7] The target assign order TASN is increased by "1", and the process returns to step B2.

Figure 13A:
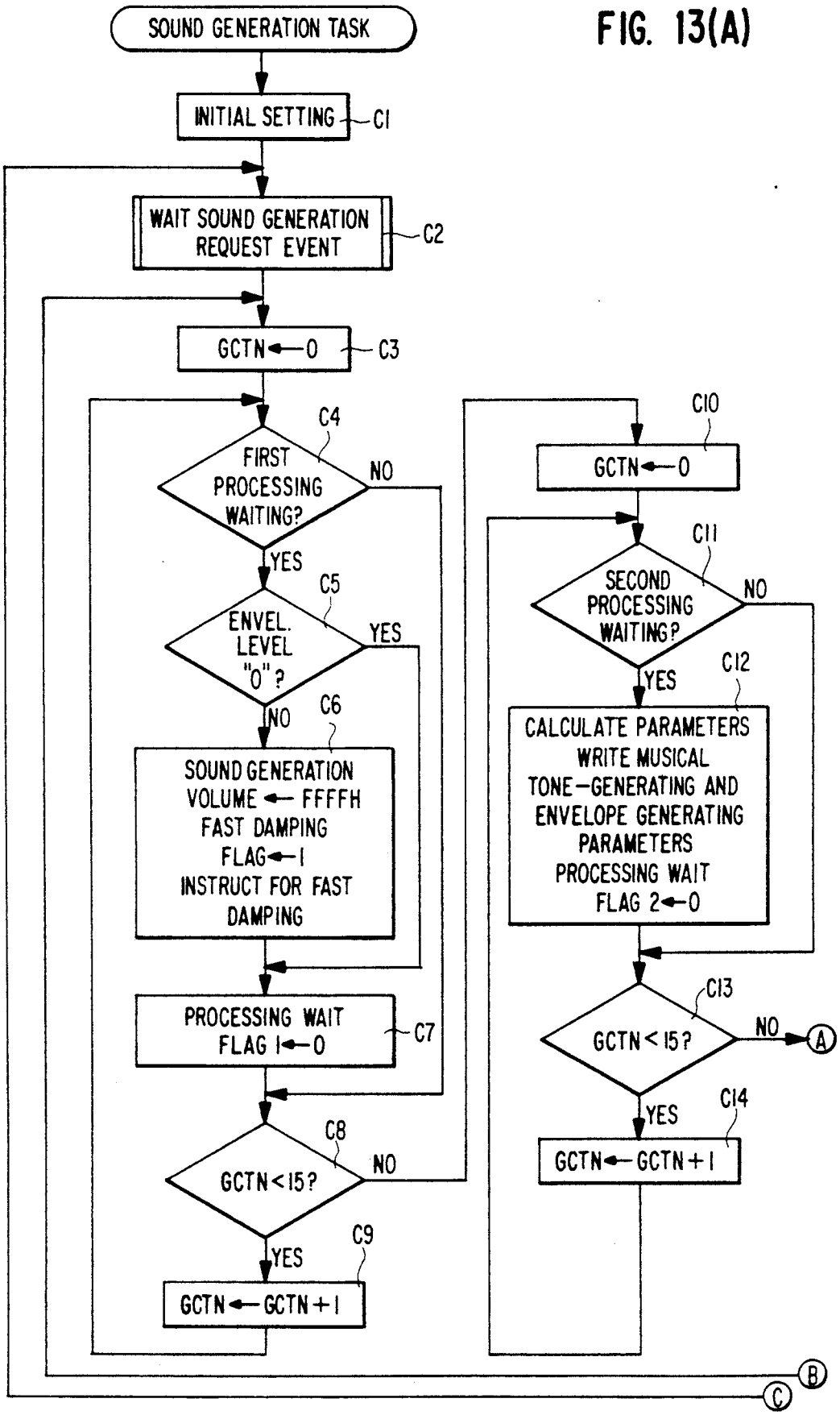
Figure 13B:
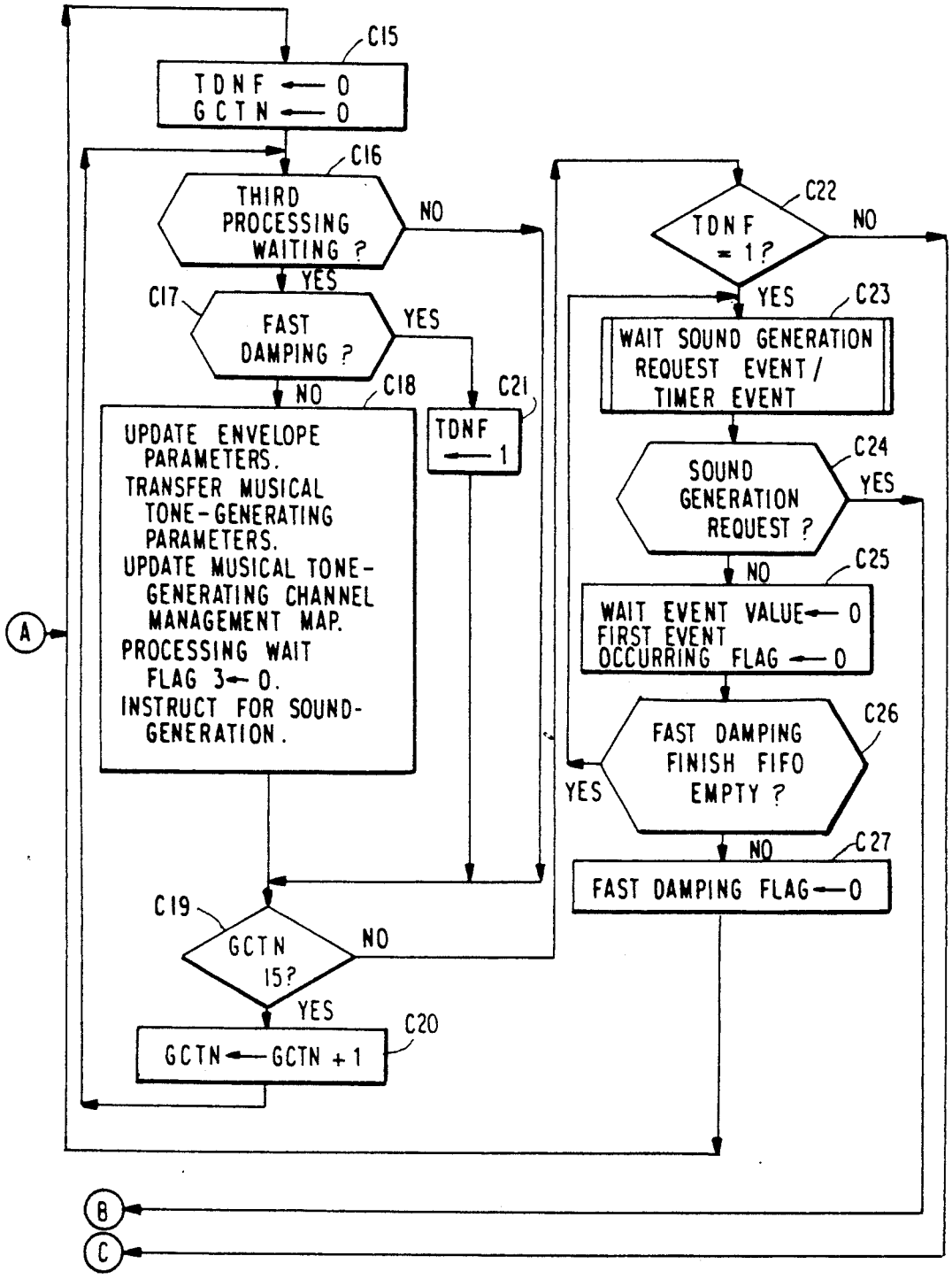

Sound generation task (FIGS. 13A and 13B)

In this task, when an sound-generating request event occurs in the case that a generation of previous musical tone has not been completed in a musical tone-generating channel which generates a new musical tone, an instruction of rapid damping is given (first processing); parameters concerning musical tone generation are calculated and set based on the note number NTNM and other data (second processing); and, when a sound generation has already been completed or is completed in the tone-generating channel, an instruction of new sound generation is given to the channel (third processing). A processing in each of the steps C1 through C27 is described in the followings.

[C1] The variables and other values to be used by this task are set to initial values, the fast damping finish FIFO storing musical tone-generating channel numbers in which a fast damping is completed are cleared, and the musical tone-generating circuit 30 is initialized. Furthermore, the third task timer counter value TCNE[3] and the third task time interval TCND [3] are set to "0", and the timer processing request flag of task number "3: sound generation task" in the task management map is set to "1: requested".

[C2] The request source event value NSET is set to "2" to execute an event wait monitor call. When a sound generation request event occurs, the process advances to the next step C3.

[C3] First, the wait event value and the second event occurring flag of task number "3: sound generation task" in the task management map are set to "0", and then, the musical tone-generating channel number for sound generation processing GCTN is set to "0".

[C4] It is judged whether or not the processing wait flag 1 of the musical tone-generating channel number corresponding to the musical tone-generating channel number for sound generation processing GCTN in the musical tone-generating channel management map is "1: process waiting". When the processing wait flag 1 is "1", the process advances to the next step C5. When it is not "1", that is, the first processing (steps C5 through C7) is not needed, the process skips to step C8.

[C5] It is judged whether or not the envelope level of the envelope channel number corresponding to the GCTN in the envelope management map is "0". When the envelope level is not "0", the process advances to the next step C6. When it is "0", that is, a fast damping process is not needed, the process skips to step C7.

[C6] The fast damping flag of the musical tone-generating channel number corresponding to the GCTN in the musical tone-generating channel management map is set to "1: fast damping", the sound generation volume is set to "FFFFH" indicating a fast damping, and an instruction of fast damping is given to the corresponding musical tone-generating channel. When this instruction is given, a target value is set to "0", a rate is set to the fast damping rate, and the settings are transferred to the corresponding musical tone-generating channel.

[C7] The processing wait flag 1 of the musical tone-generating channel number corresponding to the GCTN in the musical tone-generating channel management map is set to "0".

[C8] It is judged whether or not the GCTN is smaller than "15". When it is smaller than "15", the process advances to the next step C9. When it is not smaller than "15", that is, the first processing has been completed for all of the musical tone-generating channels, the process skips to step C10.

[C9] The GCTN is increased by "1". A preparation is made for processing for the next musical tone-generating channel, and the process returns to step C4.

[C10] The GCTN is set to "0".

[C11] It is judged whether or not the process waiting flag 2 of the musical tone-generating channel number corresponding to the GCTN in the musical tone-generating channel management map is "1: process waiting". When this processing wait flag 2 is "1", the process advances to the next step C12. When it is not "1", that is, the second processing (step C12) is not needed, the process skips to step C13.

[C12] The value of each parameter concerning a musical tone generation and its envelope generation in the musical tone-generating channel corresponding to the GCTN is calculated from the note number and velocity of the musical tone-generating channel number corresponding to the GCTN in the musical tone-generating channel management map as well as from the timbre parameter group set in step G4 of the operator data receive task which is described later. The calculated parameter values are set for the corresponding parameters in the musical tone-generating parameter group of the musical tone-generating channel number corresponding to the GCTN in the musical tone-generating channel management map, and in the group of envelope generating parameters of the envelope channel number corresponding to the GCTN in the envelope management map. At the same time, the processing wait flag 2 is set to "0".

[C13] It is judged whether or not the musical tone-generating channel number for sound generation process GCTN is smaller than "15". When it is smaller than "15", the process advances to the next step C14. When it is not smaller than "15", the process skips to step C15.

[C14] The GCTN is increased by "1", and the process returns to step C11.

[C15] The fast damping not finish flag TDNF is set to "0", and musical tone-generating channel number for sound generation processing GCTN is set to "0".

[C16] It is judged whether or not the process waiting flag 3 of the musical tone-generating channel number corresponding to the GCTN in the musical tone-generating channel management map is "1: process waiting". When it is "1", the process advances to the next step C17. When it is not "1", that is, the third processing (steps C17, C18 and C21) is not needed, the process skips to step C19.

[C17] It is judged whether or not the fast damping flag of the musical tone-generating channel number corresponding to the GCTN in the musical tone-generating channel management map is "1: fast damping". When it is not "1", the process advances to the next step C18. When it is "1", the process skips to step C21 because the second generation of a musical tone previously having been assigned to the musical tone-generating channel being an assigning channel has not been completed yet.

[C18] Based on the group of envelope generating parameters of the envelope channel number corresponding to the GCTN in the envelope management map, the target value, rate and truncate inhibit phase number of the first phase are calculated. Then, the target value, rate and truncate inhibit phase number in the envelope management map are set to the calculated values, and the phase number and envelope level are set to "1" and "0", respectively.

The sound generation volume of the musical tone-generating channel number corresponding to the GCTN in the musical tone-generating channel management map is set to the value obtained by adding "8000H" to the upper 15 bits of the attack level included in the envelope generating parameter group, and the truncate inhibit flag is set to "1: truncate inhibit".

Furthermore, the group of musical tone-generating parameters of the musical tone-generating channel number corresponding to the GCTN in the musical tone-generating channel management map is transferred, together with the target value and rate of the envelope channel number corresponding to the GCTN in the envelope management map, to the musical tone-generating channel corresponding to the GCTN in the musical tone-generating circuit 30. The processing wait flag 3 is set to "0", and an instruction of musical tone generation is given to the corresponding musical tone-generating channel.

[C19] It is judged whether or not the musical tone-generating channel number for sound generation process GCTN is smaller than "15". When it is smaller than "15", the process advances to the next step C20. Otherwise, the process skips to step C22.

[C20] The GCTN is increased by "1", and the process returns to step C16.

[C21] The fast damping not finish flag TDNF is set to "1: not finish", and the process returns to step C19.

[C22] It is judged whether or not the fast damping not finish flag TDNF is "1: not finish". When it is "1", the process advances to the next step C23. When it is not "1", that is, all sound generation processing has been completed, the process returns to step C2.

[C23] The request source event value NSET is set to "3" to execute an event wait monitor call. When either sound generation request event or timer event for a sound generation task occurs, the process advances to the next step C24.

[C24] It is judged whether or not the second event occurring flag of task number "3: sound generation task" in the task management map is "1". When it is not "1", the process advances to the next step C25. Otherwise, the process returns to step C3 because a sound generation request event has occurred.

[C25] A timer event has occurred in which the first event occurring flag of the task number "3: sound generation task" in the task management map is "1". Therefore, the wait event value of the task number "3: sound generation task" and the first event occurring flag are set to "0".

[C26] It is judged whether or not the fast damping finish FIFO in the musical tone-generating circuit 30 is "empty". When it is empty, the process returns to step C23. Otherwise, the process advances to the next step C27.

[C27] The musical tone-generating channel numbers in which an envelope level becomes "0" through the fast damping processing are unloaded sequentially from the fast damping finish FIFO, and the fast damping flag of each musical tone-generating channel number in the musical tone-generating channel management map corresponding to the musical tone-generating channel number thus unloaded is set to "0". Then, the process returns to step C15.

Figure 14:
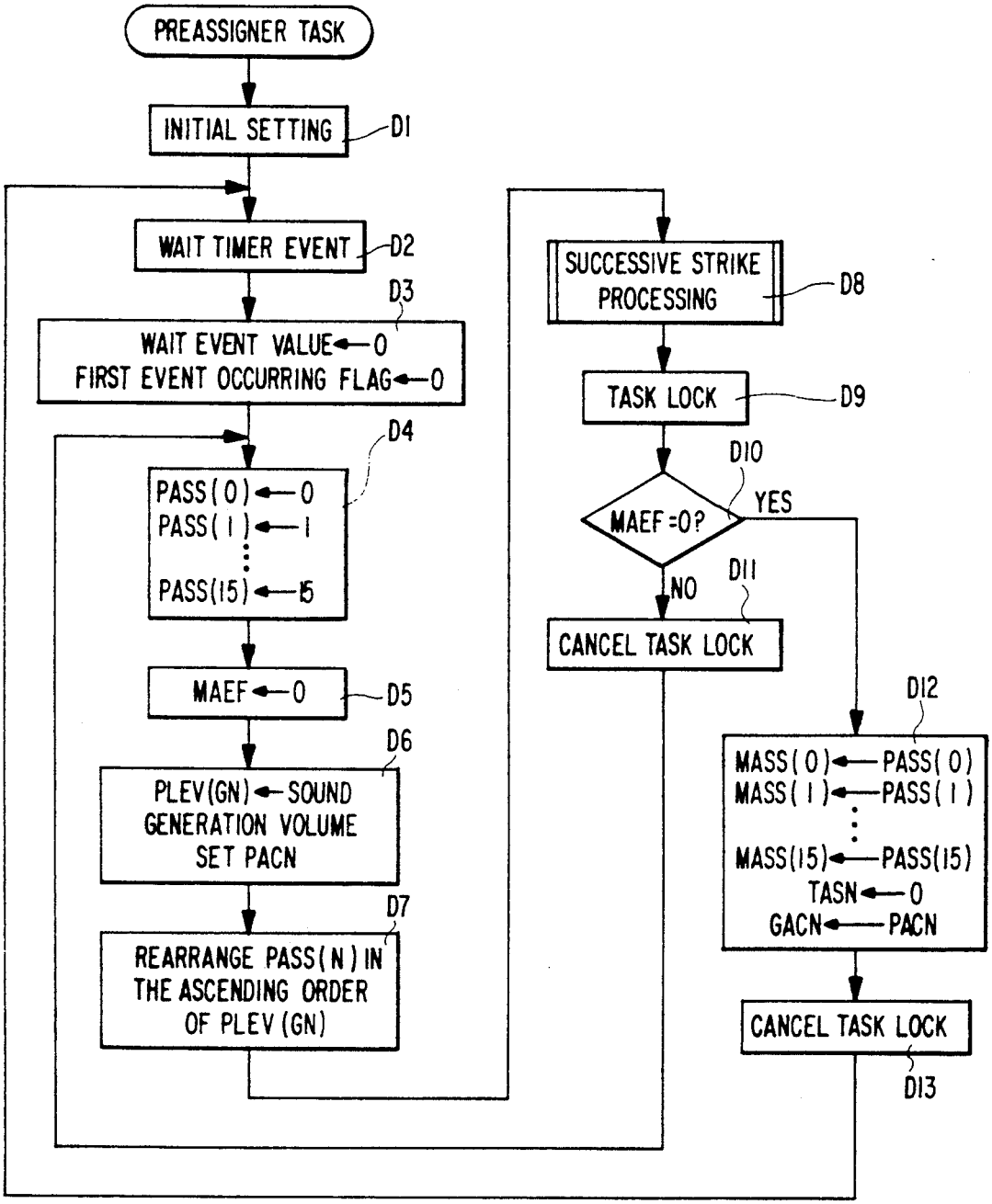

Preassigner task (FIG. 14)

When the timer event corresponding to the preassigner task occurs, this task starts a processing to update the assigning order on the basis of sound generation volume. The processing of each of the steps D1 through D13 is described in the followings.

[D1] The envelope management map is cleared, and the variables and other values to be used by this task are set to the initial values. The fourth task timer counter value TCNE[4] and the fourth task time interval TCND[4] are set to "5" and "4", respectively. Furthermore, the timer processing request flag of task number "4: preassigner task" in the task management map is set to "1: requested".

[D2] The request source event value NSET is set to "1" to execute an event wait monitor call. When the timer event in the preassigner task occurs, the process advances to the next step D3.

[D3] The wait event value and the first event occurring flag of task number "4: preassigner task" in the task management map are set to "0".

[D4] The "N"th preassign order musical tone-generating channel number PASS[N] is set to the corresponding "N(0, 1, - - - , 15)", each corresponding relation. Here, the "N"th preassign order musical tone-generating channel number PASS(N) represents the musical tone-generating channel number which is the "N"th in the preassign order.

[D5] The main assigner processing flag MAEF is set to "0".

[D6] The sound generation volume of each musical tone-generating channel number in the musical tone-generating channel management map, which is set in steps C6 and C18 of the sound generation task and updated in the step E13 of envelope task described later, is set as the preassigner sound generation volume PLEV[GN] of musical tone-generating channel number GN. The number of musical tone-generating channels whose sound generation volume is less than "8000H" (in other words, the musical tone-generating channels in which attack in ADSR expression is completed and which are not in the fast damping process) is investigated and set as the number of preassigner assignable musical tone-generating channels PACN.

[D7] The "N"th preassign order musical tone-generating channel numbers PASS(N) are rearranged in the order of the preassigner sound generation volume PLEV(GN) of the corresponding musical tone-generating channel numbers GN. For example, if the preassigner sound generation volume PLEV(GN) is larger in the order of PLEV(3), PLEV(5), PLEV(2) and so on, then the PASS(N) is: PASS(0)=3, PASS(1)=5, PASS(2)=2 and so on.

[D8] A successive-strike processing routine is executed. This routine will be described in detail on later pages with reference to the flow chart shown in FIG. 15.

[D9] A task is locked. In other words, an interruption from the key operation detecting circuit and timer circuit 27 is inhibited. Until the task lock is canceled, an execution of other tasks is inhibited, and a continuation of the current task is guaranteed.

[D10] It is judged whether or not the main assigner processing flag MAEF is "0: not processing". When it is "0", the process skips to step D12.

[D11] In the judgment in step D10, when the MAEF is not "0", in other words, when the main assigner task is executed during the processing of steps D6 through D8, by the processing based on a new key operation on the keyboard, the process returns to step D4 to cancel the task lock and to make setting again, since the sound-generating features of musical tone-generating channels are different from those at the start of step D6.

[D12] First, the "N"th preassign order musical tone-generating channel number PASS[N] is set as the corresponding "N"th assign order musical tone-generating channel number MASS[N], and the target assign order TASN is set to "0". Also, the number of preassigner assignable musical tone-generating channels PACN is set as the number of assignable musical tone-generating channels GACN.

[D13] A task lock is canceled, and the process returns to step D2. An interruption occurring during task lock is executed after the task lock cancellation.

Figure 15:
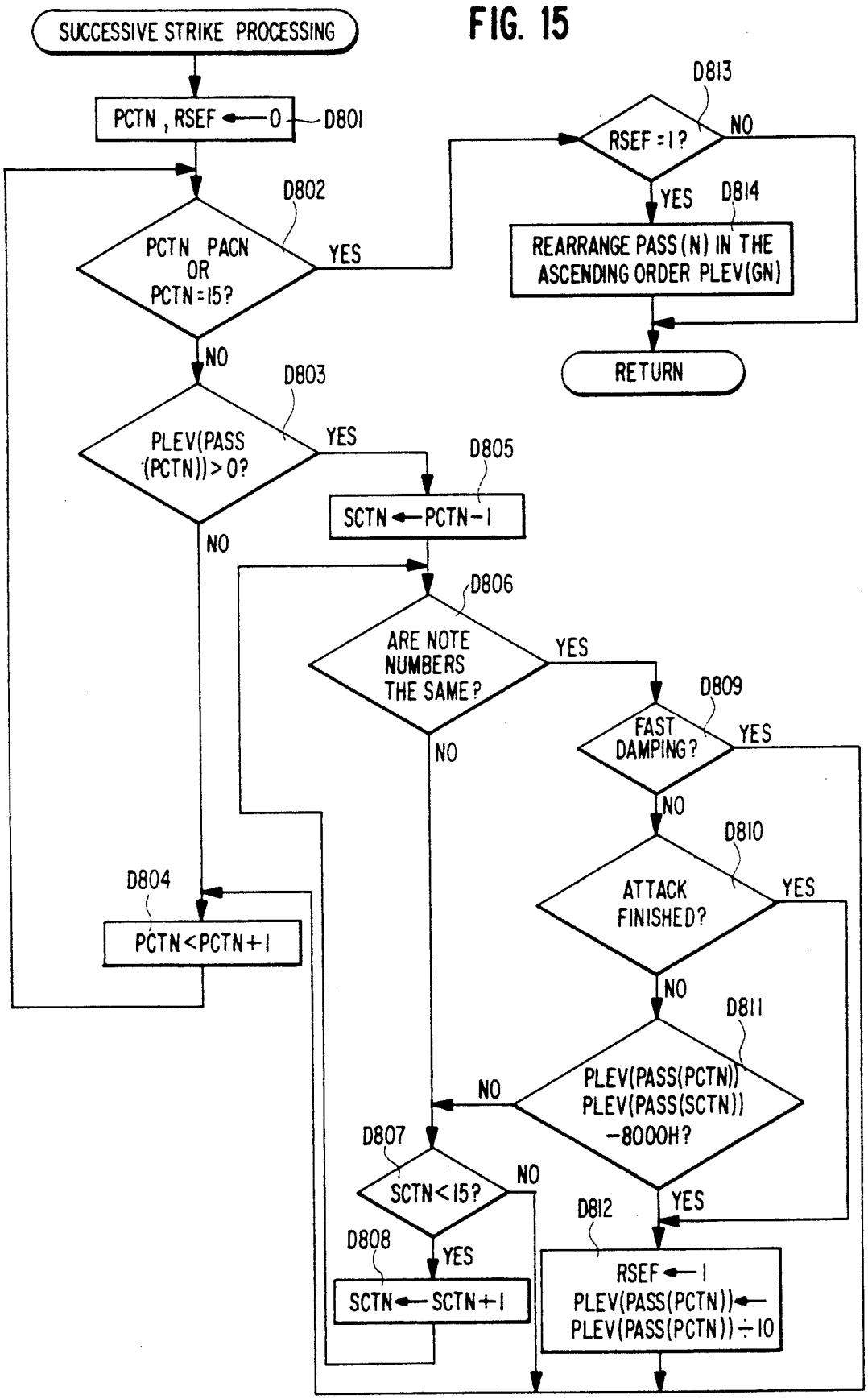

Successive-strike processing routine (FIG. 15)

In this routine, musical tone-generating channels are investigated for a successive-strike relation sequentially in the order of smaller preassigner sound generation volume. When the successive-strike relation is identified for the musical tone-generating channel number GN, the preassigner sound generation volume of this channel number PLEV[GN] is decreased to 1/10, that is, is set again. The processing of each of the steps D801 through D814 is described in the followings.

[D801] The successive-strike processing target number PCTN and successive-strike detecting flag RSEF are set to "0".

[D802] It is judged whether or not the PCTN exceeds the number preassigner assignable musical tone-generating channels PACN or is "15". When the PCTN exceeds PACN or is "15", indicating that successive-strike detection has been completed for all of the assignable musical tone-generating channels or for all of the musical tone-generating channels except for the last channel, the process skips to step D813. When the PCTN does not exceed the PACN and is not "15", the process advances to the next step D803.

[D803] It is judged whether or not the preassigner sound generation volume PLEV[PASS[PCTN]] of the musical tone-generating channel of successive-strike processing target number PCTN exceeds "0". When the PLEV[PASS[PCTN]] does not exceed "0", the process advances to the next step D804, and when it exceeds "0", the process skips to step D805.

[D804] The successive-strike processing target number PCTN is increased by "1", and the process returns to step D802.

[D805] The successive-strike comparison target number SCTN is set to a value obtained by adding "1" to the successive-strike processing target number PCTN.

[D806] It is judged whether or not the note number of the musical tone-generating channel number corresponding to the musical tone-generating channel number PASS[PCTN] of the successive-strike processing target number PCTN in the musical tone-generating channel management map is identical with the note number of the musical tone-generating channel number corresponding to the musical tone-generating channel number PASS[SCTN] of the successive-strike comparison target number SCTN. When these note numbers are not identical, the process advances to the next step D807. Otherwise, the process skips to step D809.

[D807] It is judged whether or not the successive-strike comparison target number SCTN is less than "15". When it is less than "15", the process advances to the next step D808. Otherwise, the process returns to step D804.

[D808] The SCTN is increased by "1", and the process returns to step D806.

[D809] It is judged whether or not the fast damping flag of the musical tone-generating channel number corresponding to the musical tone-generating channel number PASS[SCTN] of the successive-strike comparison target number SCTN in the musical tone-generating channel management map is "1: fast damping". When the flag is "1" indicating a fast damping, the process returns to step D804, because the condition cannot be considered as successive strikes. When the flag is not "1", the process advances to the next step D810.

[D810] It is judged whether or not the preassigner sound generation volume PLEV[PASS[SCTN]] of the musical tone-generating channel of successive-strike comparison target number SCTN is less than "8000H", in other words, whether or not an attack is finished. When the PLEV[PASS[SCTN]] is not less than "8000H", the process advances to the next step D811 because the channel is attacking. When it is less than "8000H", the process skips to step D812 because an attack has been finished.

[D811] It is judged whether or not the preassigner sound generation volume PLEV[PASS[PCTN] of the musical tone-generating channel of the successive-strike processing target number PCTN is less than the value obtained by subtracting "8000H" from of the preassigner sound generation volume PLEV[PASS[SCTN]] of the musical tone-generating channel number PASS[SCTN] of the successive-strike comparison target number SCTN, or in other words, whether or not the envelope level of the musical tone-generating channel number PASS[PCTN] of the successive-strike processing target number PCTN is less than the attack level of the musical tone-generating channel of musical tone-generating channel number PASS[SCTN] of the successive-strike comparison target number SCTN. When the envelope level is less than the attack level, the process advances to the next step D812. Otherwise, the process returns to step D807 because it is inadequate to change the PLEV[PASS[PCTN]].

[D812] First, the successive-strike detecting flag RSEF is set to "1: successive-strike detection". Then, the PLEV[PASS[PCTN]] is decreased to 1/10. In order to give a higher assigning priority to a musical tone-generating channel that has finished sound generation, over a musical tone-generating channel in which a preassigner sound generation volume has been changed by a successive-strike processing, the changed preassigner sound generation volume is set to a predetermined value ("1" in this embodiment) if it is less than "1". Then, the process returns to step D804.

[D813] It is judged whether or not the successive-strike detecting flag RSEF is "1: successive-strike detection". When it is not "1", which indicates that successive strikes are not detected, this routine is terminated, and the process returns to step D9. When the flag is "1", which indicates that successive strikes are detected, the process advances to the next step D814.

[D814] The same processing as that of step D7 is performed. Upon completion of this processing, the present routine is terminated, and the process returns to step D9.

In step D812, the preassigner sound generation volume PLEV[PASS[PCTN]] was decreased to 1/10 in the case of successive strikes. Alternatively, coefficients may be changed according to a timbre, sound pitch, etc., or the preassigner sound generation volume may be set to a predetermined value such as "1". The predetermined value to which the preassigner sound generation volume is set when it is less than "1" may be changed according to a timbre and so on.

And, in step D814, the assigning sequential order among musical tone-generating channels with a preassigner sound generation volume of less than "1" may be rearranged according to the envelope level.

In short, the assigning order is set based on the preassigner sound generation volume relating to the envelope level, and, as for successive strikes, the preassigner sound generation volume is changed to evaluate them. It must be noted that musical tone-generating channels which are in the fast damping process are excluded from the target of successive strike comparison. For the musical tone-generating channel having the largest sound generation volume of all channels with a successive strike relation, and for the one whose comparison target musical tone-generating channel is attacking and which has a larger envelope level than the attack level, the preassigner sound generation volume is not changed.

Figure 16:
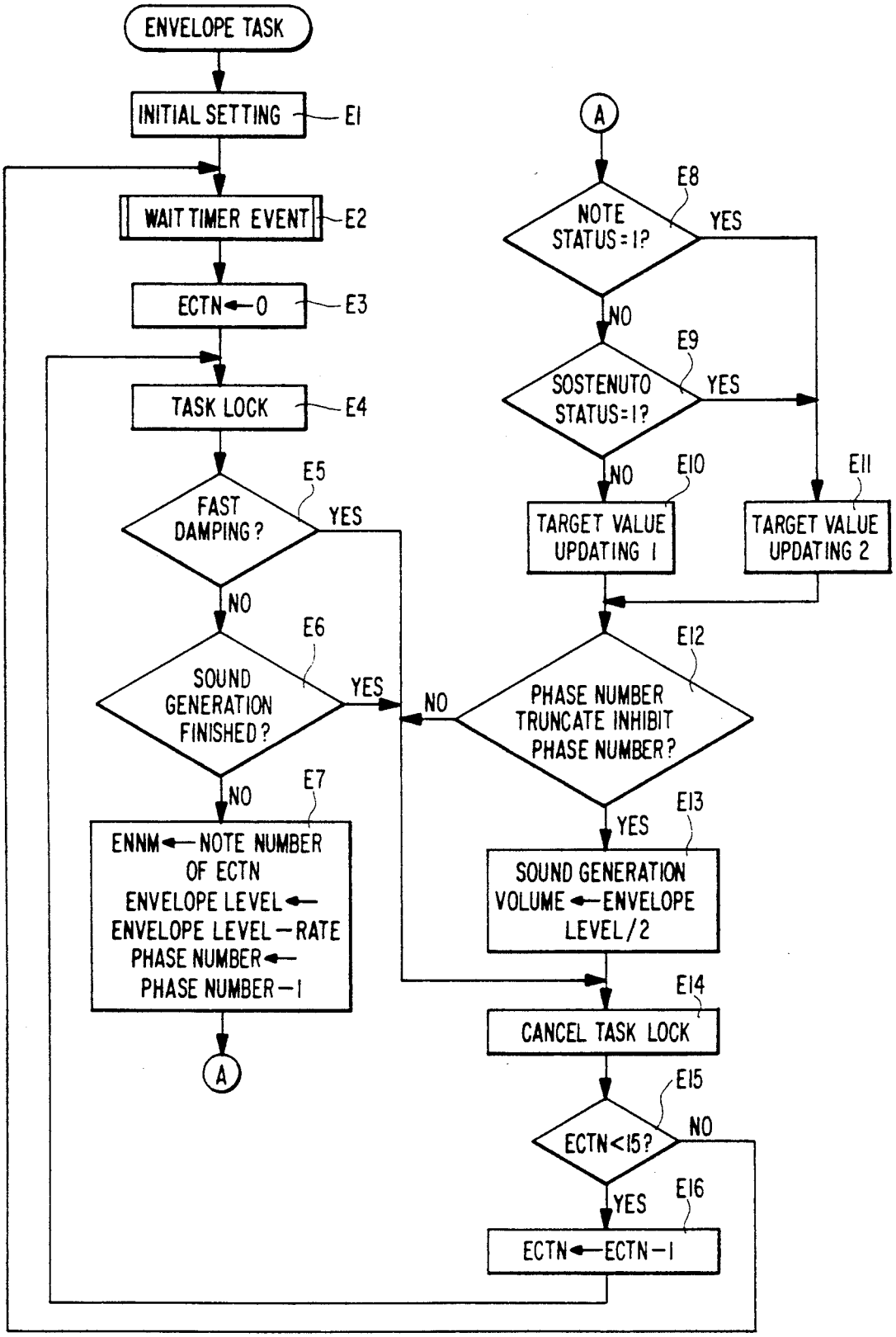

Envelope task (FIG. 16)

This task is executed when a timer event occurs for this task, so that the envelope level and sound generation volume of all envelope channels are updated sequentially, and a new target value and rate are calculated on the basis of a note status, sostenuto status, damper value and envelope generating parameter, and are transferred to musical tone-generating channels of the musical tone-generating circuit 30. A processing in each of the steps E1 through E14 is described in the followings.

[E1] The variables and other values to be used by this task are set to initial values. The fifth timer counter value TCNE[5] and the fifth task time interval TCND[5] are set to "4". The timer processing request flag of task number "5: envelope task" in the task management map is set to "1: requested".

[E2] The request source event value NSET is set to "1" to execute an event wait monitor call. When an envelope task timer event occurs, the process advances to the next step E3.

[E3] The wait event value and the first event occurring flag of task number "5: envelope task" in the task management map is set to "0", and the envelope processing target number ECTN to "0".

[E4] A task lock is executed.

[E5] It is judged whether or not the fast damping flag of the musical tone-generating channel number corresponding to the envelope processing target number ECTN in the musical tone-generating channel management map is "1: fast damping". When the flag is not "1", the process advances to the next step E6, and when "1", the process to step E14 because an envelope processing by this task is not needed.

[E6] It is judged whether or not the target value of the envelope channel number corresponding to the envelope processing target number ECTN in the envelope management map is "0", and the envelope level of it is "0". When both target value and envelope level are "0", a sound generation is completed. Therefore, the sound generation volume of the musical tone-generating channel number corresponding to the envelope processing target number ECTN in the musical tone-generating channel management map is set to "0", and the truncate inhibit flag to "0", and the process skips to step E14. When either target value or envelope level is not "0", the process advances to the next step E7.

[E7] The rate is added to the envelope level of the envelope channel number corresponding to the envelope processing target number ECTN in the envelope management map so as to obtain a new envelope level. The phase number is increased by "1". The note number of the musical tone-generating channel number corresponding to the envelope processing target number ECTN in the musical tone-generating channel management map is read and set as an envelope processing target note number ENNM.

[E8] It is judged whether or not the note status of the note number corresponding to the envelope processing target note number ENNM in the note map is "1: note-on". When it is not "1", the process advances to the next step E9, and when it is "1", the process skips to step E11.

[E9] It is judged whether or not the sostenuto status of the note number corresponding to the envelope processing target note number ENNM in the note map is "1: sostenuto on". When it is "1", the process skips to step E11.

[E10] In the judgment of step E9, when the sostenuto status is not "1", it means that the key is already released and the sostenuto pedal is not stepped down as is described later in step F4 of the pedal task, or that, if the sostenuto pedal has been stepped down, the key had already been released when the sostenuto pedal was stepped down. Therefore, the envelope processing for key release is executed. In other words, the rate and target value of the envelope channel number corresponding to the envelope processing target number ECTN in the envelope management map are calculated and updated, based on the damper value DMPV and envelope generating parameter, etc., and they are transferred to the corresponding musical tone-generating channel of the musical tone-generating circuit 30. When the processing is completed, the process skips to step E12.

[E11] When the note status is "1: note-on" in the judgment of step E8, or when the sostenuto status is "1: sostenuto on" in the judgment of step E9, it means that a key is being depressed, or that, if a key is released, the key was being depressed while the pedal was stepped down. Therefore, the envelope processing for key depressing is executed. In other words, the rate and target value of the envelope channel number corresponding to the envelope processing target number ECTN in the envelope management map are calculated and updated, on the basis on the maximum damper value and envelope generating parameter, and the updated target value and rate are transferred to the corresponding musical tone-generating channel of the musical tone-generating circuit 30.

[E12] It is judged whether or not the phase number of the envelope channel number corresponding to the envelope processing target number ECTN in the envelope management map exceeds the truncate inhibit phase number. When the phase number does not exceed the truncate inhibit phase number, the process skips to step E14, so that a sound generation volume is not updated. When the phase number exceeds the truncate inhibit phase number, the process advances to step E13 to update the sound generation volume.

[E13] The sound generation volume of the musical tone-generating channel number corresponding to the envelope processing target number ECTN in the musical tone-generating channel management map is updated to the upper 15 bits of the envelope level, and the truncate inhibit flag of the musical tone-generating channel number corresponding to the envelope processing target number ECTN in the musical tone-generating channel management map is set to "0".

[E14] A task lock is canceled.

[E15] It is judged whether or not the envelope processing target number ECTN is less than "15". When the ECTN is not less than "15", the process returns to step E2.

[E16] The envelope processing target number ECTN is increased by "1", and the process returns to step E4.

Pedal task

This task is executed with a occurrence of the timer event for this task. In this task, the setting condition of damper and sostenuto pedals is detected. Since this task is well known, only essential points will be described. A Processing of each of the steps F1 through F4 is as follows.

[F1] First, a new pedal map that stores a new setting state of each pedal, an old pedal map that stores a previous setting state of each pedal, and variables and other values to be used by this task are set to the initial values. Next, the sixth task timer counter value TCNE[6] and the sixth task time interval TCND[6] are set to "11" and "9", respectively. Furthermore, the timer processing request flag of task number "6: pedal task" in the task management map is set to "1".

[F2] The request source event value NSET is set to "1" to execute an event wait monitor call. When a pedal task timer event occurs, the process advances to the next step F3.

[F3] The wait event value and the first event occurring flag of task number "6: pedal task" in the task management map are set to "0".

[F4] Pedals are scanned to read the setting state in the predetermined order by a well-known technique, a judgement is made whether or not the setting state has been changed. If there is any change, an appropriate processing is executed. For example, when the setting state of the damper pedal has been changed, the new damper pedal depression amount is set as the damper value DMPV. When the sostenuto pedal is depressed, the sostenuto status of each note number in the note map is updated to have the same value as the corresponding note status. When the sostenuto pedal is returned to the original position, the sostenuto status of each note number in the note map is set to "0". When there is no change, or when the appropriate processing has been completed, the process returns to step F2.

Figure 17:
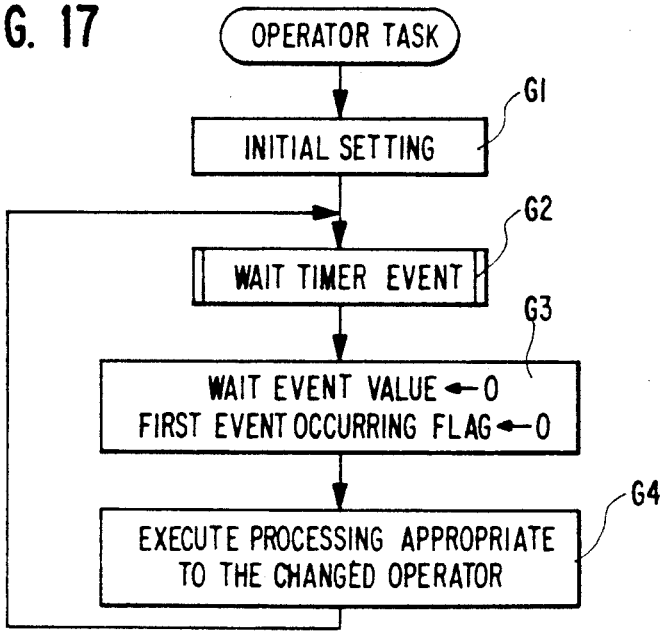

Operator task (FIG. 17)

This task is executed with a occurrence of the timer event for this task, to detect the setting state of operator group 23 which selects a timbre or sets parameter relating to the timbre. Since this task is well known, only essential points will be described. A processing in each of the steps G1 through G4 is as follows.

[G1] First, a new operator map that stores a new setting state of each operator, an old operator map that stores a previous setting state of each operator, each parameter set corresponding to the operation of each operator, and variables and other values to be used by this operator task are set to the initial values. Next, the seventh task timer counter value TCNE[7] and the seventh task time interval TCND[7] are set to "12" and "9", respectively. The timer processing request flag of task number "7: operator task" in the task management map is set to "1".

[G2] The request source event value NSET and initial setting end flag are set to "1" to execute an event wait monitor call. When an operator task timer event occurs, the process advances to the next step G3.

[G3] The wait event value and the first event occurring flag of task number "7: operator task" in the task management map are set to "0".

[G4] Operators are scanned to read the setting state in the predetermined order by a known technique, and a judgement is made whether or not the setting state has changed. When there is any change, an appropriate processing is executed. For example, when a timbre number is changed, a timbre parameter group is changed. When there is no change or the appropriate processing is completed, the process returns to step G2.

Now, the entire operation of the above described embodiment according to this invention will be described in the following paragraphs.

(1) Initial setting

When the power supply is turned on, the processing is executed by the reset routine ZA of monitor program (steps ZA1 through ZA3). Then, the initial setting processing of the key data receiving task (routine A), main assigner task (routine B), sound generation task (routine C), preassigner task (routine D), envelope task (routine E), pedal task (routine F) and operator task (routine G) are executed sequentially according to the preferential order of the tasks (steps A1 and A2, steps B1 and B2, steps C1 and C2, steps D1 and D2, steps E1 and E2, steps F1 and F2, and steps G1 and G2).

(2) Sound generation process by using received key data

When a key on the keyboard is operated and an interrupt signal is sent from the key operation detecting circuit, the key data receiving interrupt processing routine ZE of the monitor program is started.

(2-1) Since the key data receiving interrupt processing routine ZE, is waiting for a key data receive event (steps ZE1 and ZE3). The status of task number "1: key data receiving task" in the task management map is set to "0: run" (step ZE5). The key data receiving task is executed (steps A2 through A7) to read key data from the key operation detecting circuit. The note map is updated according to the key data thus read. When note-on, an event occurrence monitor call is executed (step A7).

(2-2) In the event occurrence monitor call routine ZC of the monitor program, the first event occurring flag of task number "2: main assigner task" in the task management map is set to "1" (step ZC1), and the status is set to "1: ready" (steps ZC2 and ZC3). Since the key data receiving task has higher priority than the main assigner task, the key data receiving task is started again (step ZC4) and execute an event wait monitor call in this task (step A2).

(2-3) In the event wait monitor call routine ZB of the monitor program, it is investigated whether or not a key data receiving event has occurred (step ZB1). According to this investigation, since the next key data receiving event has not occurred yet, the status of task number "1: key data receiving task" in the task management map is set to "2: wait" (step ZB2), and the task management map is investigated (step ZB3). According to this investigation, since the task number of the task having the highest priority with the status set to "1: ready", is "2: main assigner task", the status of this task number is set to "0: run" (step ZB4) to execute the main assigner task (step ZB5). In this main assigner task, the note number NTNM and other data are written in the musical tone-generating channel management map (steps B2 through B5). Next, an event occurrence monitor call is executed (step B6).

(2-4) In the event occurrence monitor call routine ZC of the monitor program, the second event occurring flag of task number "3: sound generation task" in the task management map is set to "1", and the status is set to "1: ready". Since the main assigner task has a higher priority than the sound generation task, the main assigner task is started again. In this task, the assign order of target is increased by "1" so as to update it to the next assign order (step B7), and an event wait monitor call is executed (step B2).

(2-5) In the event wait monitor call routine ZB of the monitor program, it is investigated whether or not an assigning request event has occurred. According to this investigation, since the next assigning request event has not occurred yet, the status of task number "2: main assigner task" in the task management map is set to "2: wait", so as to investigate the task management map. According to this investigation, since the task number of the highest priority having status "1: ready" is "3: sound generation task", the status of this task number is set to "0: run" to execute the sound generation task. In the sound generation task, various parameters concerning a musical tone generation are calculated and set based on the note number NTNM and other data written in the musical tone-generating channel management map, and an instruction is given for the beginning of sound generation (steps C2 through C27). Then, an event wait monitor call is executed (step C2).

(2-6) In the event wait monitor call routine ZB of the monitor program, it is investigated whether or not a sound generation request event has occurred. According to this investigation, since the next sound generation request event has not occurred yet, the status of task number "3: sound generation task" in the task management map is set to "2: wait" so as to investigate the task management map. According to this investigation, if the status of all task numbers is "2: wait", the sleep processing is executed.

(3) In the preassigner task (routine D), when the corresponding timer event occurred, the assign order is updated according to the sound generation volume in the musical tone-generating channel management map (steps D2 through D13). Then, an event wait monitor call is executed (step D2).

(4) In the envelope task (routine E), when the corresponding timer event occurs, the sound generation volume in the musical tone-generating channel management map and the envelope level in the envelope management map are updated, based on the note status, pedal data, musical tone-generating channel management map and envelope management map (steps E2 through E16). Then, an event wait monitor call is executed (step E2).

Thus, in this embodiment of the invention described above, a musical tone-generating channel, to which a new musical tone is to be assigned, is selected from musical tone-generating channels except for those in the fast damping process to be ready for a musical tone assignment and those in the attacking process in which a predetermined time has not lapsed since the beginning of sound generation. Among the assignable musical tone-generating channels, an assign order is determined according to the evaluated sound generation volume, which is obtained by changing the envelope level-based sound generation volume according to the successive strike relation. The successive strike relation is determined among the channels in the sound-generating condition (that is, the musical tone-generating channels except for those with a sound generation volume of "0" which have finished sound generation) except for those being fast damping to be prepared for a musical tone assignment.

The evaluated sound generation volume is changed based on the successive strike relation in the following processing:

① Among the musical tone-generating channels in sound-generating condition except for those being fast damping to be prepared for a musical tone assignment, the evaluated sound generation volume of the following channels is changed: the musical tone-generating channels whose sound generation volume is not the maximum and in which a predetermined time has lapsed since the beginning of sound generation so that an attacking is finished. The attack level is used for the sound generation volume of an attacking musical tone-generating channel.

② As for a musical tone-generating channel whose sound generation volume is "0" indicating completion of sound generation, the evaluated sound generation volume is already in the minimum level. Since change in the minimum evaluated sound generation volume has no effect, the evaluated sound generation volume is not changed.

③ Among the musical tone-generating channels in sound-generating condition except for those being fast damping to be prepared for a musical tone assignment, a musical tone-generating channel having the maximum sound generation volume is required to continue sound generation. Therefore, its evaluated sound generation volume is not changed, either.

④ The musical tone-generating channels being fast damping for a musical tone assignment and the attacking channels in which a predetermined time has not lapsed since the beginning of sound generation are excluded from the channels to which a new musical tone is assignable. Therefore, the evaluated sound generation volume of these channels is not changed, either.

Alternatively, among the musical tone-generating channels in the sound-generating condition except for those being fast damping to be prepared for a musical tone assignment and those in the attacking state, the evaluated sound generation volume of the channel whose sound generation volume is not the largest may be changed. Furthermore, to give a higher priority to a newer musical tone, the evaluated sound generation volume of the musical tone-generating channel whose sound generation volume is not the largest of the channels in the sound-generating condition may be changed, and the attack level of a musical tone to be assigned may be used as the sound generation volume of a musical tone-generating channel which is fast damping for a musical tone assignment.

The musical tone-generating channels in fast damping process to be prepared for a musical tone assignment and/or the attacking musical tone-generating channels in which a predetermined time has not lapsed since the beginning of sound generation may be included in the processing target, so that the evaluated sound generation volume of these channels may be changed when the sound generation volume is not the maximum. Alternatively, the evaluated sound generation volume of the musical tone-generating channels except for the one to which the last musical tone has been assigned may be changed. If necessary, the system may be designed so that the sound generation volume of a plurality of musical tone-generating channels is left unchanged.

Furthermore, the assign order may be changed directly on the basis of the successive strike relation. For example, the preassigning preferential order may be rearranged in step D8, so that the musical tone-generating channel number PASS[PCTN] of successive-strike processing target number PCTN becomes the "N"th preassigning order musical tone-generating channel number PASS[N] which is the next in the preassigning preferential order with the preassigner sound generation volume PLEV[GN] of "0". Or, the preassigning order may be rearranged so that the PASS[PCTN] becomes the "N"th preassigning order channel number PASS[N] which is next in the preassign order to the "N"th preassigning order channel number PASS[N] in the above order rearrangement.

In other words, if PLEV[3]="0", PLEV[3]<PLEV[5]<PLEV[2]<PLEV[7]<PLEV[9] - - - , and PLEV[9]<"8000H", then PASS[0]=3, PASS[1]=5, PASS[2]=2, PASS[3]=7, PASS[4]=9, - - - in the processing by the task up to step D7. Here, if the musical tone-generating channels of the numbers "2" and "9" have a successive strike relation, the preferential order is rearranged as follows: PASS[0]=3, PASS[1]=9, PASS[2]=2, PASS[3]=5, PASS[4]=7, - - - or PASS[0]=3, PASS[1]=2, PASS[2]=9, PASS[3]=5, PASS[4]=7, - - - .

Furthermore, the attacking and fast damping musical tone-generating channels may be included in the assignable channels. In other words, the process of step B4 is omitted so that even when the target assign order TASN exceeds the number of assignable musical tone-generating channels GACN, a musical tone is assigned to the channel. When the target assign order TASN exceeds "15", the assigning may be inhibited, the TASN may be reset to "0", or a new assign order may be set again. In this case, the assign order of an attacking musical tone-generating channel comes later than a musical tone-generating channel in which attack has been finished, and the assign order of a fast damping musical tone-generating channel comes later than an attacking musical tone-generating channel.

The process of setting the assign order on the basis of sound generation volume may be simplified in the following method: the assign order for musical tone-generating channels whose sound generation volume is smaller than the predetermined level is set according to the key depressing or musical tone-generating order, or the order in which the sound generation volume drops below the predetermined level. In this case, the evaluated sound generation volume less than the predetermined level need not be changed.

For simplifying the process, the musical tone-generating channels subject to a preassigning processing may be limited. For example, the key depressing order is managed by using a well known technique, so that the musical tone-generating channels corresponding to the predetermined number of key depressions counted from the last key depression are excluded from the preassigning target in the preassigner task, and a truncate is inhibited. The present embodiment uses an envelope level for the sound generation volume. Instead, a weighted envelope level may be used. Or, the envelope level detected by the amplitude level of a musical tone signal generated from a musical tone-generating channel, the false envelope level, the residual sound generation volume proposed in the Patent Laid Open Publication No. HEI1-169496, or the sound-generating duration (the time until sound generation is completed) may be used for the sound generation volume.

In this embodiment, musical tone-generating channels with the same sound pitch are considered to have a successive strike relation. When one musical tone is composed of a plurality of partial tone components, the channels with the same sound pitch and having partial tone components of the same kind may be considered to have a successive strike relation.

In the present embodiment, the assign order is changed on the basis of a successive strike relation. Instead, it may be changed based on the masking with other musical tones.

Modification 1

Now, a modified embodiment of the invention for processing successive strikes in the preassigner task is described in the followings. The variables used in the modified embodiment are as follows:

PCNN: Successive-strike processing target note number

SCNN: Successive-strike comparison target note number.

The area for key depressing order data (10) is added to the musical tone-generating channel management map. In this area, the key depressing order for the corresponding musical tone-generating channel number is indicated by "0" through "15" with the order of the oldest key depression shown by "0".

The area for preferential musical tone-generating channel numbers (3) is added to the note map. This area indicates the musical tone-generating channel numbers which generate musical tone of the corresponding note number with the high priority.

In the initial setting of the musical tone-generating channel management map in step B1 of main assigner task, the key depressing order data for each musical tone-generating channel is set to the corresponding musical tone-generating channel number. For example, the key depressing order data for a musical tone-generating channel with a channel number of "1" is set to "1".

The following processing is added to the step C12 of sound generation task.

[C12] The key depressing order data higher than the key depressing order of the musical tone-generating channel number corresponding to the musical tone-generating channel number for sound generation processing GCTN in the musical tone-generating channel management map is updated as follows:

The key depressing order higher than that of the musical tone-generating channel number corresponding to the GCTN is decreased by "1", and the key depressing order of the musical tone-generating channel number corresponding to the GCTN is set to "15". For example, when a new musical tone is assigned to the musical tone-generating channel with a key depressing order of "5", the key depressing order of the musical tone-generating channels with the key depressing order of "6" through "15", is set to "5" through "14", and that of the musical tone-generating channel to which a new musical tone was assigned is set to "15".

In the preassigner task, instead of a rearrangement of the "N"th order musical tone-generating channel numbers, the successive strike processing described below is executed in step D7, and the "N"th order musical tone-generating channel numbers of step D7 before change are rearranged in step D8.

Figure 18:
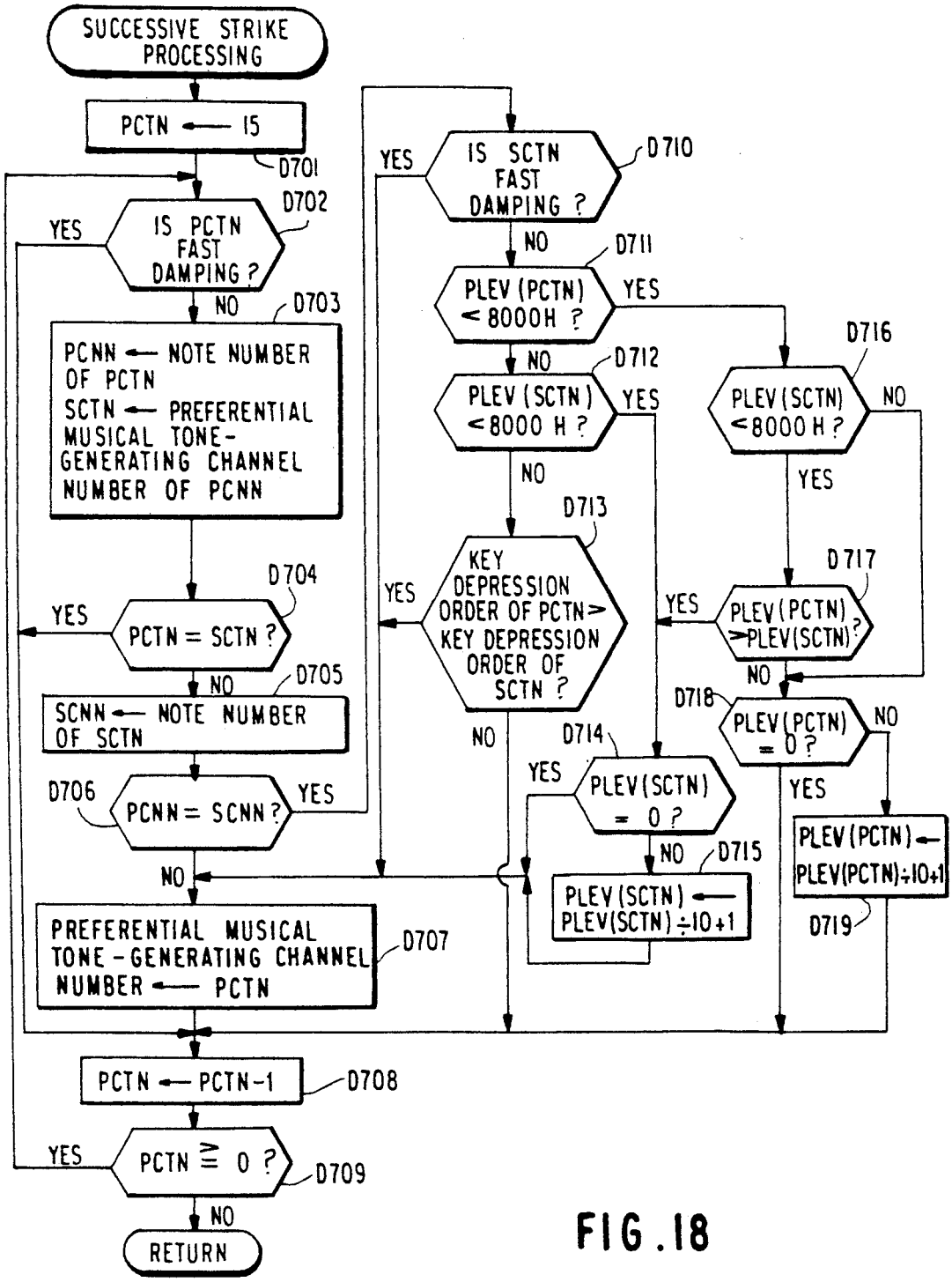

Successive-strike processing routine (FIG. 18)

In this routine, musical tone-generating channels are investigated for a successive strike relation sequentially in the order of smaller preassigner sound generation volume. For a channel with the successive strike relation, the preassigner sound generation volume is decreased to 1/10 and is set again. A processing of each of the steps D701 through D719 is described in the followings.

[D701] The successive-strike processing target number PCTN is set to "15", and the process advances to the next step D702.

[D702] It is judged whether or not the fast damping flag of the musical tone-generating channel number corresponding to the successive-strike processing target number PCTN in the musical tone-generating channel management map is "1: fast damping". When the flag is "1", the process skips to step D708. Otherwise, the process advances to the next step D703.

[D703] First, the note number of the musical tone-generating channel number corresponding to the PCTN in the musical tone-generating channel management map is set as successive-strike processing target note number PCNN, and the key depressing order of this tone-generating channel is set as the successive-strike processing target key depressing order PCPN. Next, the preferential musical tone-generating channel number of the note number corresponding to the PCNN in the note map is set as the successive-strike comparison target number SCTN. Then, the process advances to the next step D704.

[D704] It is judged whether or not the successive-strike processing target number PCTN is the same as the successive-strike comparison target number SCTN. When they are the same, the process skips to step D708. Otherwise, the process advances to the next step D705.

[D705] The note number of the successive-strike comparison target number SCTN is set as the successive-strike comparison target note number SCNN.

[D706] It is judged whether or not the successive-strike processing target note number PCNN is the same as the successive-strike comparison target note number SCNN. When they are the same, the process skips to step D710. Otherwise, the process advances to the next step D707.

[D707] The preferential musical tone-generating channel number of the note number corresponding to the PCNN in the note map is updated to the successive-strike processing target number PCTN.

[D708] The successive strike processing target number PCTN is decreased by "1".

[D709] It is judged whether or not the successive-strike processing target number PCTN is equal to or more than "0". When it is equal to or more than "0", the process returns to step D702. Otherwise, the successive-strike processing routine is terminated to go to step D8.

[D710] It is judged whether or not the damping flag of the successive-strike comparison target number SCTN is "1: fast damping". When the flag is "1", the process returns to step D707. Otherwise, the process advances to the next step D711.

[D711] It is judged whether or not the preassigner sound generation volume PLEV[PCTN] of the successive-strike processing target number PCTN is less than "8000H", or in other words, whether or not the musical tone-generating channel whose number is the successive-strike processing target number PCTN has completed attack. When the PLEV[PCTN] is less than "8000H" so that attack has been completed, the process skips to step D716. When it is not less than "8000H", the process advances to the next step D712.

[D712] It is judged whether or not the preassigner sound generation volume PLEV[SCTN] of the successive-strike comparison target number SCTN is less than "8000H", or in other words, whether or not the musical tone-generating channel whose number is the successive-strike comparison target number SCTN has completed attack. When the PLEV[SCTN] is less than "8000H" so that attack has been completed, the process skips to step D714. Otherwise, the process advances to the next step D713.

[D713] It is judged whether or not the key depressing order of the musical tone-generating channel number corresponding to the successive-strike processing target number PCTN in the musical tone-generating channel management map is higher than that of the musical tone-generating channel number corresponding to the successive-strike comparison target number SCTN. When the former is higher than the latter, the process returns to step D707. Otherwise, the process returns to step D708.

[D714] and [D715] It is judged whether or not the preassigner sound generation volume PLEV[SCTN] of the successive-strike comparison target number SCTN is "0". When the PLEV[SCTN] is "0", the process returns to step D707 without any processing. When the PLEV[SCTN] is not "0", the PLEV[SCTN] is updated to a value obtained by dividing the same by "10" and adding "1" to the result. Then, the process returns to step D707.

[D716] It is judged whether or not the preassigner sound generation volume PLEV[SCTN] of the successive-strike comparison target number SCTN is less than "8000H", or in other words, whether or not the musical tone-generating channel whose channel number is the successive-strike comparison target number SCTN has completed attack. When the PLEV[SCTN] is less than "8000H" so that attack has been completed, the process advances to the next step D717. Otherwise, the process skips to step D718.

[D717] It is judged whether or not the preassigner sound generation volume PLEV[PCTN] of the successive-strike processing target number PCTN is greater than the preassigner sound generation volume PLEV[SCTN] of the successive-strike comparison target number SCTN. When the former is greater than the latter, the process returns to step D714. Otherwise, the process advances to the next step D718.

[D718] and [D719] It is judged whether or not the preassigner sound generation volume PLEV[PCTN] of the successive-strike processing target number PCTN is "0". When the PLEV[PCTN] is "0", the process returns to step D708 without any special processing. Otherwise, the PLEV[PCTN] is updated to a value obtained by dividing the same by "10" and adding "1" to the result. Then, the process returns to step D708.

In step D713, when musical tone-generating channels for successive-strike processing and successive-strike comparing targets are both attacking, a key depressing order is compared between the two channels. The attack level may be compared instead of the key depressing order. In other words, the same judgment as in step D717 is made, and, when the preassigner sound generation volume PLEV[PCTN] of the successive-strike processing target number PCTN is larger, the process returns to step D707. Otherwise, the process returns to step D708.

Second embodiment

Now, a second embodiment of an assigning device of an electronic musical instrument according to the present invention will be described with reference to the accompanying drawings, for the case where the device is applied to an electronic musical instrument which generates continuous musical tones.

Difference from the first example

The musical tone-generating channel management map is changed as follows.

The following memory area is deleted.

(1) Sound generation volume

The following memory areas are added.

(10) Note status

(11) Key depressing order: A key depressing order is indicated by "0" through "15", with the order of the oldest key depression by "0".

(12) Stage number: Each stage of preassign processing is shown by "0" through "5": sound generation finish by "0", key release and hold-off by "1", key release and damper-on by "2", key release and sostenuto-on by "3", key depressing and truncate inhibit cancel by "4", and key depressing and truncate inhibiting by "5". The hold-off indicates the state of damper-off and sostenuto-off.

(13) Preassigning order: A preassigning order is shown by "0" through "15", with the earliest order by "0".

(14) In-stage preassigning order: A preassigning order in each processing stage is shown by "1" through "16", with the earliest order by "1".

(15) Successive-strike flag: A successive-strike is shown by "1".

A preassign processing FIFO is provided.

The following variables are added for the second embodiment:

CRQF Preassigning process request flag: A preassign processing request in the sound generation task is shown by "1".

PEXM Processing mode: A processing mode is shown by "1" through "4": key depression by "1", attack processing by "2", key release by "3", and sound generation finish by "4".

POAS Old preassigning order

PNAS New preassigning order

POSN Old stage number

PNSN New stage number

PDSN Lower stage number

POSA Old preassigning order in stage

PNSA New preassigning order in stage

PSAM[POSN] Maximum preassigning order in the old stage number POSN

PSRM[POSN] Maximum successive-strike order in the old stage number POSN

PSAM[PNSN] Maximum preassigning order in the new stage number PNSN

PSRM[PNSN] Maximum successive-strike order in the new stage number PNSN

PSAM[PDSN] Maximum preassigning order in the lower stage number PDSN

PNTN Preassigner note number

ERQF Preassign processing request flag: A preassign processing request in the envelope task is shown by "1".

The step A6 of key data receive task is changed as described, and step A8 is added.

[A6] First, the note status of the note number corresponding to the note number NTNM in the note map is set to "0". Next, the musical tone-generating channel number with the note number of the NTNM in the musical tone-generating channel management map and with the note status of "1" is searched for in the key depressing order, and the note status of the musical tone-generating channel number having the lowest key depressing order is set to "0". Then, the number "3" representing a key release process and musical tone-generating channel numbers are loaded sequentially in the preassign processing FIFO, and the process advances to step A8.

[A8] A preassign request event is generated. In other words, the request destination task number NDTK is set to "4: preassigner task", and the request destination event value NDET to "1", to execute an event occurrence monitor call, and then the process returns to step A2.

A part of the processing of main assigner task is changed as follows:

The following processing is added to step B1.

[B1] The preassigning order and key depressing order of each musical tone-generating channel number in the musical tone-generating channel management map are set to each corresponding musical tone-generating channel number.

The next processing is added to step B5.

[B5] The number "1" representing a key depression processing and musical tone-generating channel numbers are loaded sequentially in the preassign processing FIFO.

A part of the processing of sound generation task is changed as follows: The following processing is added to step C3.

[C3] The preassign processing request flag CRQF is set to "1".

The step C5 is changed as follows:

[C5] It is judged whether or not the stage number of the musical tone-generating channel number corresponding to the musical tone-generating channel number for sound generation processing GCTN in the musical tone-generating channel management map is "0". When the stage number is not "0", the process advances to the next step C6. When it is "0" indicating that a fast damping process is not needed, the process skips to step C7.

The process of setting sound generation volume in steps C6 and C12 is deleted.

The following processing is added to step C12.

[C12] A key depressing order higher than that of the musical tone-generating channel number corresponding to the musical tone-generating channel number for sound generation processing GCTN in the musical tone-generating channel management map is updated as follows:

The key depressing order higher than that of the musical tone-generating channel number corresponding to the GCTN is decreased by "1", and the key depressing order of the musical tone-generating channel number corresponding to the GCTN is set to "15". For example, when a new musical tone is assigned to the musical tone-generating channel with a key depressing order of "5", the key depressing order of the musical tone-generating channels with the key depressing order of "6" through "15", is updated to "5" through "14", and that of the musical tone-generating channel to which a new musical tone was assigned is updated to "15".

Prior to the processing of step C22, the following processing is executed:

[C22p] It is judged whether or not the preassign processing request flag CRQF is "1". When it is "1", the process advances to the next step C22q. Otherwise, the process skips to step C22.

[C22q] A preassign request event is generated. In other words, the request destination task number NDTK is set to "4: preassigner task", and the request destination event value NDET to "1", to execute an event occurrence monitor call. Further, the preassign processing request flag CQRF is set to "0", and the process advances to step C22.

Figure 19:
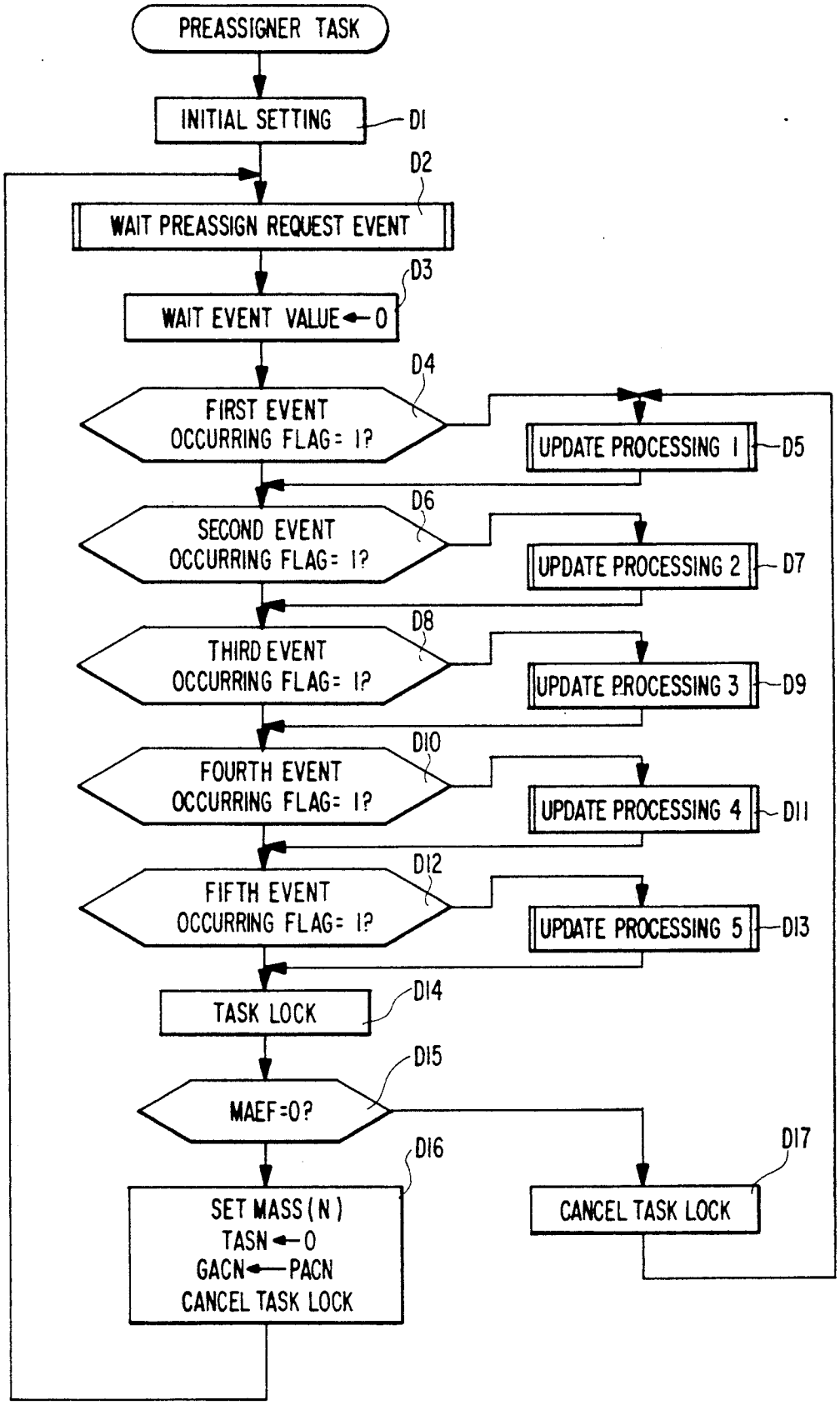
FIG. 19 through FIG. 22 are flow charts of preassigner task, update processing (11) routine, successive strike processing routine and update processing (12) routine, for explanation of a second embodiment of an assigning device of an electronic musical instrument according to the present invention.

The preassigner task is changed as follows: (FIG. 19)

[D1] The envelope management map and preassign processing FIFO are cleared, and variables and other data used by the preassigner task is set to the initial values. In this initial setting of variables, the number of preassigner assignable musical tone-generating channels PACN and the maximum preassigning order in stage PSAM[0] for stage number "0" are set to "16", and the other variables to "0".

[D2] The request source event value NSET is set to "31" to execute an event wait monitor call. When the preassign request event occurs, the process advances to the next step D3.

[D3] The wait event value of task number "4: preassigner task" in the task management map is set to "0".

[D4] and [D5] It is judged whether or not the first event occurring flag is "1". When it is "1", an updating process 1 is executed. This updating process 1 is described later in detail

[D6] and [D7] It is judged whether or not the second event occuring flag is "1". When it is "1", an updating process 2 is executed. This updating process 2 is described later in detail.

[D8] and [D9] It is judged whether or not the third event occurring flag is "1". When it is "1", an updating process 3 is executed. This updating process 3 is described later in detail.

[D10] and [D11] It is judged whether or not the fourth event occuring flag is "1". When it is "1", an updating process 4 is executed. This updating process 4 is described later in detail.

[D12] and [D13] It is judged whether or not the fifth event occurring flag is "1". When it is "1", an updating process 5 is executed. This updating process 5 is described later in detail.

[D14] A task lock is executed.

[D15] It is judged whether or not the main assigner processing flag MAEF is "0". When it is "0", the process advances to the next step D16. Otherwise, the process skips to step D17.

[D16] First, the "N"th assign order musical tone-generating channel number MASS[N] is set sequentially, based on the musical tone-generating channel numbers and the preassigning preferential order in the musical tone-generating channel management map. For example, when the preassigning preferential order of musical tone-generating channel number "0" is "5", the fifth assign order musical tone-generating channel number MASS[5] is set to "0". Then, the target assign order TASN is set to "0", and the number of preassigner assignable musical tone-generating channels PACN is set as the number of assignable musical tone-generating channels GACN. The task lock is canceled to return to step D2.

[D17] The task lock is canceled to return to step D5.

Update processing 1 routine

This routine is used to update a preassigning order based on a key depression, attack finish, key release or sound generation finish.

[D51] First, the first event occurring flag of task number "4: preassigner task" in the task management map is set to "0". Next, the main assigner processing flag MAEF is set to "0".

[D52] Data are unloaded from the preassign processing FIFO and set as the processing mode PEXM.

[D53] The processing mode PEXM is identified. When the PEXM is "1", the process advances to the next step D54; when "2", the process skips to step D55; when "3", the process skips to step D56; and when "4", the process skips to step D57.

[D54] An update processing 11 is executed. The content of this processing is described later in detail, referring to FIG. 20. The process skips to step D58.

[D55] An update processing 12 is executed. The content of this processing is described later in detail. The process skips to step D58.

[D56] An update processing 13 is executed. The content of this processing is described later in detail. The process skips to step D58.

[D57] An update processing 14 is executed. The content of this processing is described later in detail. The process advances to step D58.

[D58] It is judged whether or not the preassign processing FIFO is "empty". When it is "empty", this routine is terminated to go to the step D6 of preassigner task. When not "empty", the process returns to step D52.

Figure 20:
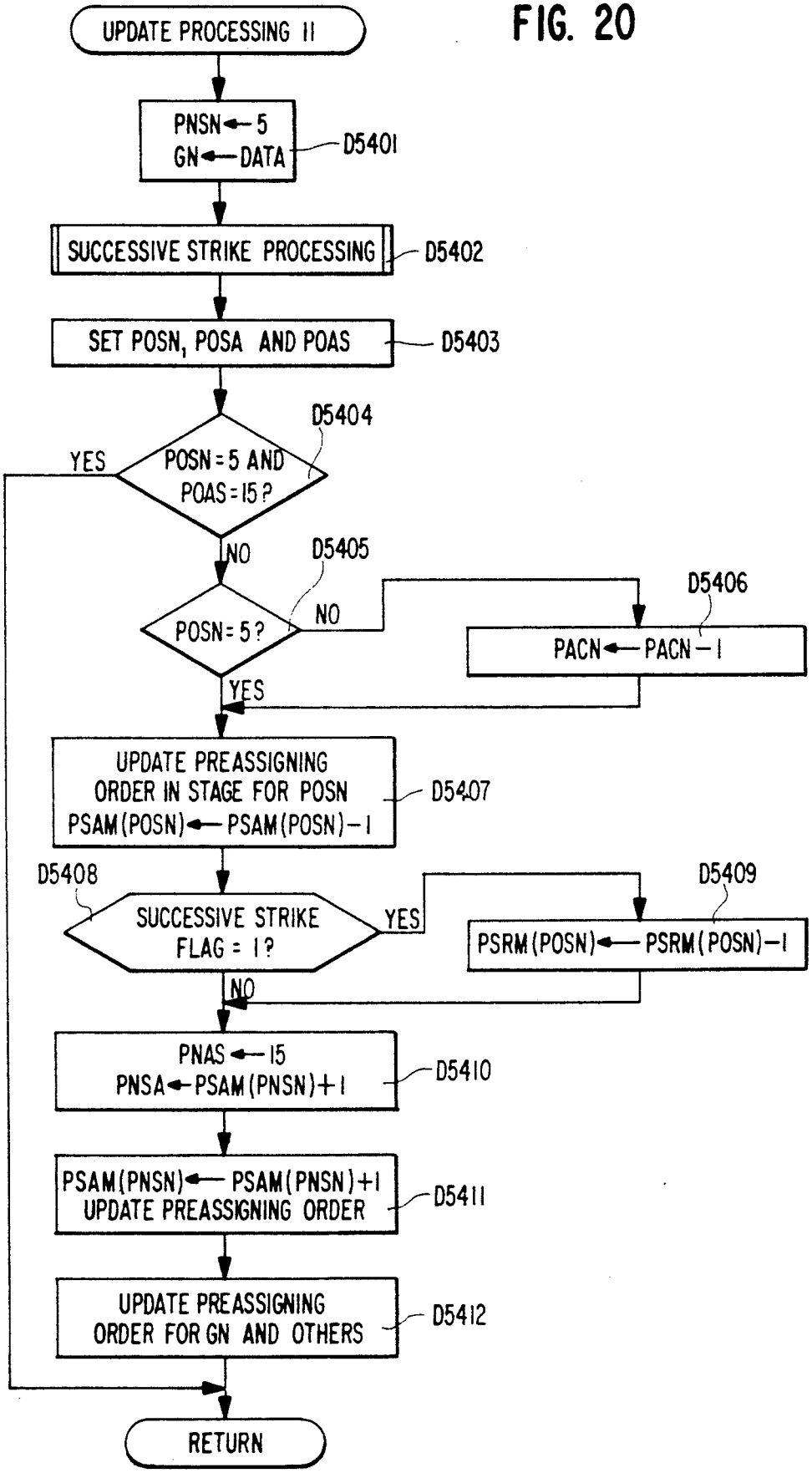

Update processing 11 routine (FIG. 20)

This routine is used to update the preassigning order of a musical tone-generating channel which newly started a sound generation in response to a key depression.

[D5401] First, the new stage number PNSN is set to "5". Then, data are unloaded from the preassign processing FIFO and set as the musical tone-generating channel number GN.

[D5402] A successive-strike processing is executed. The content of this processing is described later in detail, referring to FIG. 21.

[D5403] The stage number of musical tone-generating channel number corresponding to the musical tone-generating channel number GN in the musical tone-generating channel management map is set as the old stage number POSN, the preassigning order in stage is set as the old preassigning order in stage POSA, and the preassigning order is set as the old preassigning order POAS.

[D5404] It is judged whether or not the old stage number POSN is "5" and the old preassigning order POAS is "15". When the POSN is not "5", or the POAS is not "15", the process advances to the next step D5405. When the POSN is "5", and the POAS is "15", this routine is terminated to skips to step D58.

[D5405] and [D5406] It is judged whether or not the old stage number POSN is "5". When the POSN is not "5", the number of preassigner assignable musical tone-generating channels PACN is decreased by "1".

[D5407] First, in the stage whose number in the musical tone-generating channel management map is the old stage number POSN, each preassigning order, from the old preassigning order POAS in the stage plus "1" up to the maximum preassigning order in stage PSAM[POSN] for the stage number POSN, is decreased by "1". Next, the maximum preassigning order in stage PSAM[POSN] for the stage number POSN is decreased by "1".

[D5408] and [D5409] It is judged whether or not the successive-strike flag of the musical tone-generating channel number corresponding to the musical tone-generating channel number GN in the musical tone-generating channel management map is "1". When the flag is "1", the maximum successive-strike order in stage PSRM[POSN] for the stage number POSN is decreased by "1".

[D5410] The new preassigning order PNAS is set to "15". The value obtained by adding "1" to the maximum preassigning order in stage PSAM[PNSN] for the stage number PNSN is set as the new preassigning order in stage PNSA.

[D5411] The maximum preassigning order in stage PSAM[PNSN] for the stage number PNSN is increased by "1". Each preassigning order, from the old preassigning order POAS plus "1" in the musical tone-generating management map up to the new preassigning order PNAS is decreased by "1".

[D5412] The stage number of the musical tone-generating channel number corresponding to the musical tone-generating channel number GN in the musical tone-generating channel management map is set to the new stage number PNSN, the preassigning order in stage is set to the new preassigning order in stage PNSA, the preassigning order is set to the new preassigning order PNAS, and the successive-strike flag is set to "0". Then, this routine is terminated to skips to step D58.

Figure 21:
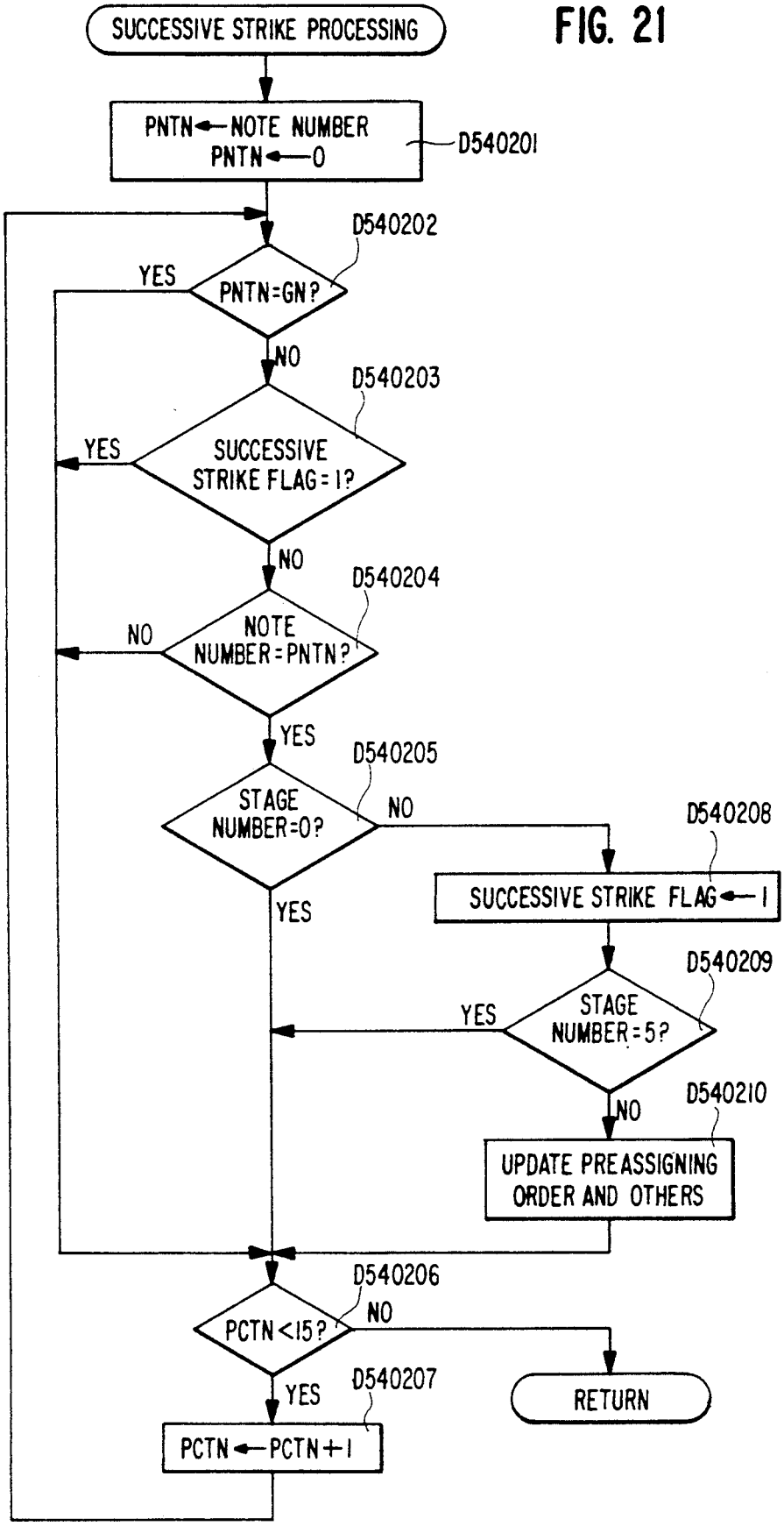

Successive-strike processing routine (FIG. 21)

[D540201] First, the note number of the musical tone-generating channel number corresponding to the musical tone-generating number GN in the musical tone-generating channel management map is set as the preassigner note number PNTN. Next, the successive-strike processing target number PCTN is set to "0".

[D540202] It is judged whether or not the successive-strike processing target number PCTN is the same as the musical tone-generating channel number GN. When the PCTN is not the same as the GN, the process advances to the next step D540203. Otherwise, the process skips to step D540206.

[D540203] It is judged whether or not the successive-strike flag of the musical tone-generating channel number corresponding to the PCTN in the musical tone-generating channel management map is "1". When the successive-strike flag is not "1", the process advances to the next step D540204. Otherwise, the process skips to step D540206.

[D540204] It is judged whether or not the note number of the musical tone-generating channel number corresponding to the PCTN in the musical tone-generating channel management map is the same as the preassigner note number PNTN. When they are the same, the process advances to the next step D540205. Otherwise, the process skips to step D540206.

[D540205] It is judged whether or not the stage number of the musical tone-generating channel number corresponding to the PCTN in the musical tone-generating channel management map is "0". When the stage number is "0", the process advances to the next step D540206. Otherwise, the process skips to step D540208.

[D540206] and [D540207] It is judged whether or not the successive-strike processing target number PCTN is less than "15". When the PCTN is less than "15", it is increased by "1", and the process returns to step D540202. When the PCTN is not less than "15", this routine is terminated to skips to step D5403.

[D540208] The successive-strike flag of the musical tone-generating channel number corresponding to the successive-strike processing target number PCTN in the musical tone-generating channel management map is set to "1".

[D540209] It is judged whether or not the stage number of the musical tone-generating channel number corresponding to the PCTN in the musical tone-generating channel management map is "5". When it is not "5", the process advances to the next step D540210. Otherwise, the process returns to step D540206.

[D540210] The preassigning order and others in the musical tone-generating channel management map are updated in the following way:

(1) The stage number of the musical tone-generating channel number corresponding to the successive-strike processing target number PCTN in the musical tone-generating channel management map is set as the old stage number POSN and new stage number PNSN, the preassigning order in stage is set as the old in-stage preassigning order POSA, and the preassigning order is set as the old preassigning order POAS.

(2) It is judged whether or not the maximum successive-strike order in stage PSRM[PNSN] for the stage number PNSN is more than "0". When it is more than "0", the process advances to the next (3). Otherwise, the process skips to (4).

(3) First, the maximum successive-strike order in stage PSRM[PNSN] for the stage number PNSN is set as the new preassigning order in stage PNSA. Next, "1" is added to the preassigning order of the musical tone-generating channel number whose stage number in the musical tone-generating channel management map is the new stage number PNSN and whose preassigning order in stage is the new preassigning order in stage PNSA, and the sum thus obtained is set as the new preassigning order PNAS. Further, the value obtained by adding "1" to the new preassigning order in stage PNSA is set as the new preassigning order in stage PNSA. Then, the process skips to (5).

(4) First, the preassigning order in stage PNSA is set to "1". Next, the preassigning order, whose stage number in the musical tone-generating channel management map is the new stage number PNSN and whose preassigning order in stage is the new preassigning order in stage PASA, is set as the new preassigning order PNAS. Then, the process advances to the next (5).

(5) In the stage whose number in the musical tone-generating channel management map is the new stage number PNSN, each preassigning order, from the new preassigning order in stage PNSA up to the old preassigning order in stage POSA minus "1", is increased by "1".

⑥ Each preassigning order, from the new preassigning order PNAS up to the old preassigning order POAS minus "1" in the musical tone-generating channel management map, is increased by "1".

⑦ The preassigning order in stage for the successive-strike processing target number PCTN in the musical tone-generating channel management map is set to the new preassigning order in stage PNSA, and the preassigning order is set to the new preassigning order PNSA.

⑧ The maximum successive-strike order in stage PSRM[PNSN] for the stage number PNSN is increased by "1", and the process advances to step D540206.

Figure 22:
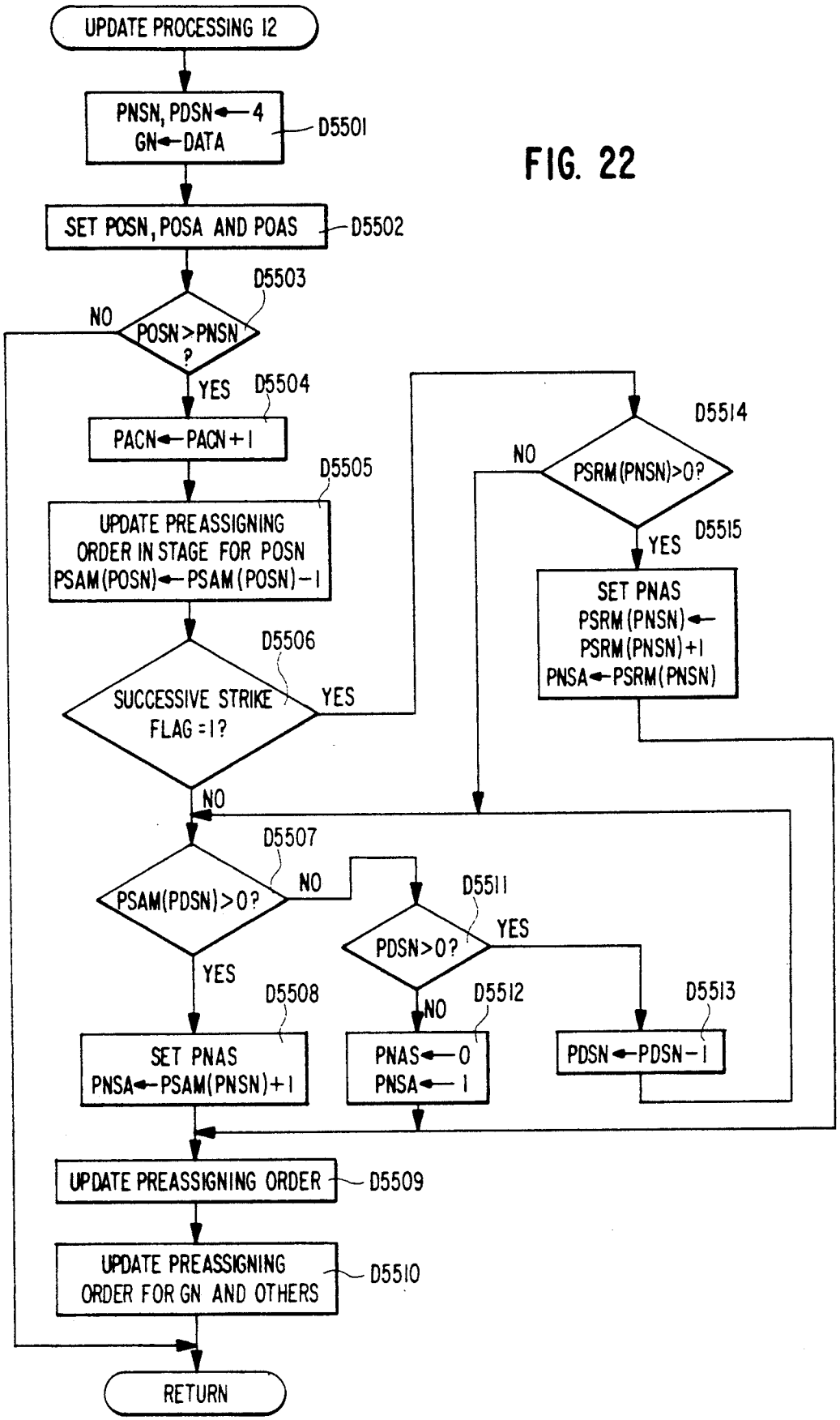

Update processing 12 routine (FIG. 22)

This routine is used to update the preassigning order of a musical tone-generating channel in which attack has been finished.

[D5501] First, the new stage number PNSN and the lower stage number PDSN are set to "4". Next, data are unloaded from the preassign processing FIFO, and set as the musical tone-generating channel number GN.

[D5502] The same processing is executed as in the step D5403 of update processing 11 routine.

[D5503] It is judged whether or not the old stage number POSN exceeds the new stage number PNSN. When the POSN exceeds the PNSN, the process advances to the next step D5504. Otherwise, this routine is terminated to go to step D58.

[D5504] The number of preassigner assignable musical tone-generating channels PACN is increased by "1".

[D5505] The same processing is executed as in the step D5407 of update processing routine 11.

[D5506] The same processing is executed as in the step D5408 of update processing routine 11. When the successive-strike flag in this processing is not "1", the process advances to the next step D5507, and when the flag is "1", the process skips to step D5514.

[D5507] It is judged whether or not the maximum preassigning order in stage PSAM[PDSN] for the stage number PDSN exceeds "0". When it exceeds "0", the process advances to the next step D5508. Otherwise, the process skips to step D5511.

[D5508] First, the maximum preassigning order in stage PSAM[PDSN] for the stage number PDSN is set as the new preassigning order in stage PNSA. Next, "1" is added to the preassigning order of musical tone-generating channel number whose stage number is the lower stage number PDSN and whose preassigning order in stage is the new preassigning order in stage PNSA, in the musical tone-generating channel management map, and the sum value is set as the new preassigning order PNAS. Further, "1" is added to the maximum preassigning order in stage PSAM[PNSN] for the stage number PNSN, and the sum value is set as the preassigning order in stage PNSA.

[D5509] The maximum preassigning order in stage PSAM[PNSN] for the stage number PNSN is increased by "1", and each preassigning order, from the new preassigning order PNAS up to the old preassigning order POAS minus "1" in the musical tone-generating channel management map, is increased by "1".

[D5510] The same processing is executed as in the step D5412 of update processing routine 11. However, the successive strike-flag is not changed.

[D5511] It is judged whether or not the lower stage number PDSN exceeds "0". When it exceeds "0", the process skips to step D5513. Otherwise, the process advances to the next step D5512.

[D5512] The new preassigning order PNAS is set to "0", and the new preassigning order in stage PNSA to "1".

[D5513] The value obtained by subtracting "1" from the lower stage number PDSN is set as the lower stage number PDSN, and the process returns to step D5507.

[D5514] It is judged whether or not the maximum successive-strike order in stage PSRM[PNSN] for the stage number PNSN exceeds "0". When it exceeds "0", the process advances to the next step D5515, Otherwise, the process returns to step D5507.

[D5515] First, the maximum successive-strike order in stage PSRM[PNSN] for the stage number PNSN is set as the new preassigning order in stage PNSA. Next, "1" is added to the preassigning order of musical tone-generating channel whose stage number is the new stage number PNSN and whose preassigning order in stage is the new preassigning order in stage PNSA in the musical tone-generating channel management map, and the sum value is set as the new preassigning order PNAS. Further, the maximum successive-strike order in stage PSRM[PNSN[ for the stage number PNSN and the new preassigning order in stage PNSA are increased by "1". Then, the process returns to step D5509.

Update processing 13 routine

This routine is used to update the preassigning order of a musical tone-generating channel for which a key has been released by the same processing as in the update processing 12 routine. The difference from the update processing 12 routine is described in the following.

[D5601] First, the new stage number PNSN is set to "3". Then, data are unloaded from the preassign processing FIFO and set as the musical tone-generating channel number GN.

[D5604] It is judged whether or not the old stage number POSN is "5". When it is "5", the number of preassigner assignable musical tone-generating channels PACN is increased by "1".

Prior to the processing of step D5606, the processing of steps D5606P through D5606U is executed.

[D5606P] The note number of the musical tone-generating channel number corresponding to the musical tone-generating channel number GN in the musical tone-generating channel management map is set as the preassigner note number PNTN.

[D5606Q] It is judged whether or not the sostenuto status of the note number corresponding to the preassigner note number PNTN in the note map is "0". When it is "0", the process advances to the next step D5606R. Otherwise, the process skips to step D5606U.

[D5606R] It is judged whether or not the damper flag DMPF is "0". When it is "0", the process advances to the next step D5606S. Otherwise, the process skips to step D5606T.

[D5606S] The new stage number PNSN and lower stage number PDSN are set to "1", and the process goes to step D5606.

[D5606T] The new stage number PNSN and lower stage number PDSN are set to "2", and the process goes to step D5606.

[D5606U] The new stage number PNSN and lower stage number PDSN are set to "3", and the process goes to step D5606. Prior to step D5614, the following processing is executed.

[D5614P] It is judged whether or not the old stage number POSN is "5". When it is not "5", the maximum successive-strike order in stage PSRM[POSN] for the stage number POSN is decreased by "1".

Update processing 14 routine

This routine is used to update the preassigning order of a musical tone-generating channel in which sound generation has been finished by the same processing as in the update processing 12 routine. The difference from the update processing 12 routine is described in the followings.

[D5701] First, the new stage number PNSN and lower stage number PDSN are set to "0". Then, data are unloaded from the preassign processing FIFO, and set as the musical tone-generating channel number GN.

[D5704] It is judged whether or not the old stage number POSN is "5". When the POSN is "5", the number of preassigner assignable musical tone-generating channels PACN is increased by "1".

Instead of the steps D5714 and D5715, the following processing is executed.

[D5714] It is judged whether or not the old stage number POSN is "5". When the POSN is not "5", the maximum successive-strike order in stage PSRM[POSN] for the stage number POSN is decreased by "1".

In step D5710, the same processing as in the step D5412 of update processing 11 routine is conducted.

Update processing 2 routine

This routine is used to update the preassigning order of a musical tone-generating channel in which a key has been released and a sostenuto is "on" by the operation of a sostenuto pedal.

[D71] First, the second event occurring flag of task number "4: preassigner task" in the task management map is set to "0". Next, the old stage number POSN and old preassigning order in stage POSA are set to "1", and the new stage number PNSN and lower stage number PDSN are set to "3".

[D72] It is judged whether or not the old preassigning order in stage POSA exceeds the maximum preassigning order in stage PSAM[POSN] for the stage number POSN. When the former does not exceed the latter, the process advances to the next step D73. Otherwise, this routine is terminated to go to step D8.

[D73] A musical tone-generating channel number, whose stage number is the old stage number POSN and whose preassigning order in stage is the old preassigning order in stage POSA in the musical tone-generating channel management map, is set as the musical tone-generating channel number GN. The note number is set as the preassigner note number PNTN.

[D74] It is judged whether or not the sostenuto status of the note number corresponding to the preassigner note number PNTN in the note map is "1". When it is "1", the process advances to the next step D75. Otherwise, the old preassigning order in stage POSA is increased by "1", and the process returns to step D72.

[D75] The preassigning order of the musical tone-generating channel number corresponding to the musical tone-generating channel number GN in the musical tone-generating channel management map is set as the old preassigning order POAS.

[D76] The same processing as in steps D5605 through D5615 of the update processing 13 routine is executed. However, the processing in steps D5606P through D5606U is not executed. In the step D5609, the same processing as in step D5411 of the update processing 11 routine is performed. After this, the process returns to step D72.

Update processing 3 routine

This routine is used to update the preassigning order of a musical tone-generating channel in which a key has been released and a hold is "off"by the operation of a sostenuto pedal.

[D91] First, the third event occurring flag of task number "4: preassigner task" in the task management map is set to "0". Next, the old stage number POSN is set to "3", and the old preassigning order in stage POSA is set to "1".

[D92] It is judged whether or not the damper flag DMPF is "1". When it is "1", the process advances to the next step D93. Otherwise, the process skips to step D94.

[D93] The new stage number PNSN and lower stage number PDSN are set to "2", and the process skips to step D95.

[D94] The new stage number PNSN and lower stage number PDSN are set to "1", and the process advances to the next step D95.

[D95] It is judged whether or not the maximum preassigning order in stage PSAM[POSN] for the stage number POSN exceeds "0". When it exceeds "0", the process advances to the next step D96. Otherwise, this routine is terminated to go to step D10.

[D96] The preassigning order of a musical tone-generating channel number whose stage number in the musical tone-generating channel map is the old stage number POSN and whose preassigning order in stage is "1" is set as the old preassigning order POAS.

[D97] The same processing as in steps D5605 through D5615 of the update processing 13 routine is executed. However, the processing of steps D5606P through D5606U is not executed. After this, the process returns to step D95.

Update processing 4 routine

This routine is used to update the preassigning order of a musical tone-generating channel in which a key has been released and a damper is "on" by the operation of a damper pedal.

[D111] First, the fourth event occurring flag of task number "4: preassigner task" in the task management map is set to "0". Next, the old stage number POSN and old preassigning order in stage POSA are set to "1", and the new stage number PNSN and lower stage number PDSN are set to "2".

[D112] The same judgement is made as in the step D72 of update processing 2 routine. When the old preassigning order in stage POSA does not exceed the maximum preassigning order in stage PSAM[POSN] for the stage number POSN, the process advances to the next step D113. When the former exceeds the latter, this routine is terminated to go to step D12.

[D113] The same processing as in the step D73 of update processing 2 routine is executed.

[D114] The same judgment is made as in the step D72 of update processing 2 routine. When the sostenuto status is "0", the process advances to the next step D115. Otherwise, the old preassigning order in stage POSA is increased by "1", and the process returns to step D112.

[D115] The same processing as in the step D75 of update processing 2 routine is executed.

[D116] The same processing as in the step D76 of update processing 2 routine is executed. After this, the process returns to step D112.

Update processing 5 routine

This routine is used to update the preassigning order of a musical tone-generating channel in which a key has been released and a hold is "off" by the operation of a damper pedal.

[D131] First, the fifth event occurring flag of task number "4: preassigner task" in the task management map is set to "0". Next, the old stage number POSN is set to "2", and the old preassigning order in stage POSA, new stage number PNSN and lower stage number PDSN are set to "1".

[D132] The same judgment is made as in the step D95 of update processing 3 routine. When the maximum preassigning order in stage PSAM[POSN] for the stage number POSN exceeds "0", the process advances to the next step D133. Otherwise, this routine is terminated to go to step D14.

[D133] The same processing as in the step D96 of update processing 3 routine is executed.

[D134] The same processing as in the step D97 of update processing 3 routine is executed. After this, the process returns to step D132.

A part of the processing in the envelope task is changed as follows.

The following process is added to step E1:

[E1] The preassign processing request flag ERQF is set to "0".

Step E6p is added. The step E6p is carried out after step E5.

[E6p] It is judged whether or not the stage number of the musical tone-generating channel number corresponding to the envelope processing target number ECTN in the musical tone-generating channel management map is "0". When the stage number is "0", the process skips to step E14. When it is not "0", the process advances to the next step E6.

Step E6 is changed as follows, and step E6a is added.

[E6] It is judged whether or not the note status of the musical tone-generating channel number corresponding to the envelope processing target number ECTN in the musical tone-generating channel management map and the target value and envelope level of the envelope channel number corresponding to the number ECTN in the envelope management map are all "0". When all of them are "0", the process advances to the next step E6a. When one of them is not "0", the process skips to step E7.

[E6a] The preassign processing request flag ERZF is set to "1", and "4" showing the sound generation finish processing and the envelope processing target number ECTN are loaded in the preassign processing FIFO. The truncate inhibit flag of the musical tone-generating channel number corresponding to the number ECTN in the musical tone-generating channel management map is set to "0", and the process skips to step E14.

Steps E8 and E9 are changed as follows:

[E8] It is judged whether or not the note status of the musical tone-generating channel number corresponding to the envelope processing number ECTN in the musical tone-generating channel management map is "1". When the note status is not "1", the process advances to the next step E9. Otherwise, the process skips to step E11.

[E9] It is judged whether or not the damper flag DMPF or the sostenuto status of the note number corresponding to the envelope processing target note number ENNM in the note map is "1". When either of them is "1", the process skips to step E11a. When neither of them is "1", the process advances to the next step E10.

A part of the processing of steps E10 and E11 and the processing of step E13 are changed as described below, and steps E11a and E12p are added:

[E10] Updating of a target value, rate, etc. is not based on the damper value DMPV. Upon completion of the processing, the process skips to step E12p.

[E11] Updating of a target value, rate, etc. is not based on the damper value PMPV. Upon completion of the processing, the process skips to step E12p.

[E11a] The rate of the envelope channel number corresponding to the envelope processing target number ECTN in the envelope management map is updated to "0", and the target value and rate are transferred to the musical tone-generating circuit 30. After this, the process advances to the next step E12p.

[E12p] It is judged whether or not the truncate inhibit flag of the musical tone-generating channel number corresponding to the envelope processing target number ECTN in the musical tone-generating channel management map is "0". When the flag is "0", the process skips to step E14. Otherwise, the process goes to step E12.

[E13] The truncate inhibit flag of the musical tone-generating channel number corresponding to the envelope processing target number ECTN in the musical tone-generating channel management map is set to "0", and the preassign processing request flag ERQF is set to "1". The number "2" showing the attack finish processing and the envelope processing target number ECTN are loaded sequentially in the preassign processing FIFO.

Steps E17 and E18 are added. When the envelope processing target number ECTN is not less than "15" in step E15, the process advances to the next step E17.

[E17] It is judged whether or not the preassign processing request flag ERQF is "1". When it is "1", the process advances to step E18. Otherwise, the process returns to step E2.

[E18] A preassign request event is generated. In other words, the request destination task number NDTK is set to "4: preassigner task", and the request the destination event value NDET is set to "1" so as to execute an event occurrence monitor call. The preassign processing request flag ERQF is set to "0", and the process returns to step E2.

A part of the processing of step F4 of pedal task is changed as follows:

When a damper pedal is depressed, the damper flag DMPF is set to "1". When the damper pedal is returned, the flag is set to "0".

Upon completion of updating a sostenuto status and/or setting a damper flag, a preassign request event is generated. In other words, the request destination task number NDTK is set to "4: preassigner task", and the request destination event value NDET is set to "2" when a sostenuto pedal is depressed, to "3" when the sostenuto pedal is returned, to "4" when a damper pedal is depressed, and to "5" when the damper pedal is returned, so as to execute an event occurrence monitor call.

As described above, in this embodiment of the invention, a musical tone-generating channel to which a new musical tone is to be assigned is selected from among the channels except for those damping fast to be prepared for a musical tone assignment and those in the attacking state in which a predetermined period has not lapsed from the start of sound generation. A musical tone is assigned to the assignable channels in the order of a sound generation finished channel, key released and hold-off channel, key released and damper-on channel, key released and sostenuto-on channel, and key depressing channel. Among the channels in the same state, or for example among key released and hold-off channels, the channel having a successive strike relation is assigned earlier than the one without a successive strike relation. When a new musical tone is assigned to a tone-generating channel, the assign order of a musical tone-generating channel having a successive strike relation with the assigned musical tone is changed so that it is assigned earlier than a channel in the same state. For example, for a musical tone-generating channel in the key released and hold-off state, the assign order is changed so that the channel is assigned earlier than a channel in the key released and hold-off state and having no successive strike relation. When the state of a channel is changed, or specifically, when a key depressed for musical tone generation is released, the assign order is changed depending on the presence of successive strike relation. For example, when a key is released with the pedal not depressed, the assign order of a channel having a successive strike relation is changed so that it is assigned next to the musical tone-generating channel in the last assign order which is in the key released and hold-off state and has a successive-strike relation. When the channel does not have a successive strike relation, the assign order is changed so that the channel is assigned next to the channel in the last assign order which is in the key released and hold-off state.

In this embodiment as well, the musical tone-generating channels which are damping fast for musical tone assignment and the attacking channels in which a predetermined period has not lapsed since the start of sound generation may be included in the assignable channels and in the channels subject to successive strike processing, as necessary. For musical tone-generating channels in which a key has been released, the processing similar to that in the first embodiment may be conducted.

Furthermore, the main assigner processing flag MAEF may be set to "1" when operation or sostenuto pedal is detected, in steps A6, E6, E13 and F4. In the step D540208 of successive-strike processing routine, the successive-strike flag setting may not be conducted when the target musical tone-generating channel is in the key depression state and its envelope level is higher than the attack level of the musical tone-generating channel to which a new musical tone has been assigned.

The change of the assign order depending on the presence of successive strike relation as mentioned above may be modified so that the target channel is assigned earlier. For instance, when the assign order of a musical tone-generating channel in which a key is being depressed is assigned, the channel may be considered as the one in the key released and sostenuto-on state. Specifically, the following processing is executed in step D540210.

In the step (1), the new stage number PNSN and lower stage number PDSN are set to the value obtained by subtracting "1" from the stage number of the musical tone-generating channel number corresponding to the successive-strike processing target number PCTN in the musical tone-generating channel management map. Instead of the (2) and subsequent steps, the same processing as in steps D5507 through D5513 is executed.

Alternatively, when the assign order of a musical tone-generating channel in which a key is being depressed is assigned, the channel may be considered as the one in the key released and hold-off state. Further, a channel in which a key is being depressed may be assigned next to a channel in which sound generation has been finished, that is, in the order of a channel in which sound generation has been finished, a channel with a successive strike relation, a channel in the key released and hold-off state, and so on. When a musical tone is to be assigned to channels in the key depressing order, the key depressing order may be changed so that the key has been depressed earlier. A musical tone assignment is performed in the order of a channel in which sound generation has been finished, a channel with a successive strike relation, and a channel with no successive strike relation, and, among the channels in each state, the assignment is performed in the key depressing order. For channels in which sound generation has been finished, the assignment may be performed in the order of musical tone-generating channel numbers.

In the first and second embodiments, the assign order is changed based on the successive strike relation among musical tones already assigned. Instead, the assign order may be changed based on the successive strike relation with a new musical tone to be assigned. For example, prior to the processing of step B5 of the main assigner task, the same processing as the preassigner task is executed. In this processing, a new musical tone is considered to have been assigned to the hypothetical 17th musical tone-generating channel provided as a successive-strike comparison target, and a successive-strike processing is executed for the channels including the hypothetical 17th channel. In this case, the preassigner task may be deleted.

Alternatively, the assign order set in the preassigner task may be changed based on the decision on the successive strike relation with a new musical tone in the main assigner task. Specific examples of this processing are shown in the following modifications 2 and 3.

Modification 2

According to this modified embodiment, a new musical tone is assigned in the following way:

If the musical tone-generating channel of the target assign order has finished sound generation, a musical tone is assigned to this channel. However, if the channel of the target assign order has not finished sound generation, a musical tone is assigned to another assignable musical tone-generating channel which has a successive strike relation with a new note-on message. If there is no assignable musical tone-generating channel having a successive strike relation with a new note-on message, a musical tone is assigned the musical tone-generating channel of the target assign order.

Now, the application of this modification to the first embodiment is described.

Prior to the processing of step B4 of main assigner task, the following processing is executed:

[B5p] In the judgment of step B4, when the target assign order TASN is less than the number of assignable musical tone-generating channels GACN:

① It is judged whether or not the sound generation volume of the musical tone-generating channel number corresponding to the musical tone-generating channel number MASS[TASN] of the target assign order TASN in the musical tone-generating channel management map exceeds "0". When the sound generation volume exceeds "0", the process advances to the next ②. When it does not exceed "0", or in other words when sound generation has been finished, the process goes to step B5.

② The musical tone-generating channel corresponding to the musical tone-generating channel number MASS[TASN] of the target assign order TASN is investigated in the order of assignment, from the channel of the target assign order TASN up to the number of assignable musical tone-generating channels GACN minus "1", to find the musical tone-generating channel whose note number is identical with the note number NTNM. Specifically, the note number and note number NTNM are compared for each musical tone-generating channel number corresponding to the musical tone-generating channel number MASS[TASN] of the target assign order TASN which is investigated in the assignment order in the musical tone-generating channel management map from the channel of the target assign order TASN to the number of assignable musical tone-generating channels GACN minus "1". When there is a musical tone-generating channel in which note number is identical with the note number NTNM, the assign order is rearranged so that this one-generating channel comes to the assignment turn.

In short, the assign order of the first musical tone-generating channel identified to have a note number equal to the note number NTNM is set as the target assign order TASN. Then, the assign order of each musical tone-generating channel number corresponding to the musical tone-generating channel number MASS[TASN] of the target assign order TASN, from the target assign order TASN to the assign order obtained by subtracting "1" from the assign order of the first channel whose note number conforms to the NTNM, is increased by "1". For example, under the condition of TASN="0", GACN="10", MASS[0]=5, MASS[1]=7, MASS[2]=8, and MASS[3]=9, when the note number conforms to the NTNM for a musical tone-generating channel with the assign order of "3" (MASS[3]), it becomes MASS[0]=9, MASS[1]=5, MASS[2]=7 and MASS[3]=8. When the above processing is completed, the process goes to step B5.

When there is no musical tone-generating channel whose note number conforms to the note number NTNM, the process goes to step B5.

This modification can also be applied to the second embodiment if changed appropriately.

Modification 3

In this modified embodiment, a new musical tone is assigned in the following way:

If a musical tone-generating channel of the target assign order has completed a sound generation, a musical tone is assigned to this channel. If the musical tone-generating channel of the target assign order has not completed a sound generation and has a successive strike relation with a new note-on message, a musical tone is assigned to this channel. On the other hand, if the musical tone-generating channel of the target assign order has not completed sound generation, and if there is an assignable musical tone-generating channel having a successive strike relation with a new note-on message, a musical tone is assigned to this channel having the successive strike relation only where the hypothetical value of a tenth of the sound generation volume of this channel is smaller than the sound generation volume of the musical tone-generating channel of the target assign order which has been corrected for the successive strike relation. If there is no assignable musical tone-generating channel having a successive strike relation with a new note-on message, or if the hypothetical value of a tenth of the sound generation volume of an assignable musical tone-generating channel having the successive strike relation is not smaller than the sound generation volume of the channel of the target assign order which has been corrected for the successive strike relation, a musical tone is assigned to the channel of the target assign order.

Application of this modification to the first embodiment is described in the followings.

The processing of ② in the step B5p of Modification 2 is changed as follows:

② It is judged whether of not the musical tone-generating channel of the target assign order TASN has a successive strike relation with a new note-on musical tone. Specifically, a decision is made whether or not the note number of the musical tone-generating channel number corresponding to the musical tone-generating channel number MASS[TASN] of the target assign order TASN in the musical tone-generating channel management map is identical with the note number NTNM. When these note numbers conform to each other, the process goes to step B5. Otherwise, the process advances to the next ③.

③ The sound generation volume of the musical tone-generating channel number corresponding to the musical tone-generating channel number MASS[TASN] of the target assign order TASN in the musical tone-generating channel management map is set as a sound generation volume for evaluation.

④ It is judged whether or not the musical tone-generating channel of the target assign order TASN has a successive strike relation with any one of the musical tone-generating channels corresponding to the channel number MASS[TASN] of the target assign order TASN from the assign order next to the target assign order TASN to the assign order obtained by subtracting "1" from the number of assignable musical tone-generating channels GACN. Specifically, it is judged whether or not there is conformance between the note number of the musical tone-generating channel number corresponding to the musical tone-generating channel number MASS[TASN] of the target assign order TASN in the musical tone-generating channel management map and the note number of any one of the musical tone-generating channel numbers corresponding to the musical tone-generating channel number MASS[TASN] of the target assign order TASN from the assign order next to the target assign order TASN to the one obtained by subtracting "1" from the number of assignable musical tone-generating channels GACN. When there is conformance between the two note numbers, the sound generation volume for evaluation is reduced to a tenth. When there is no conformance, the sound generation volume for evaluation is not changed. When the processing is finished, the process advances to the next (5).

(5) Each musical tone-generating channel corresponding to the channel number MASS[TASN] of the target assign order TASN whose sound generation volume is less than a tenth of the sound generation volume for evaluation is investigated in the assignment order from the assign order next to the target assign order TASN to the one obtained by subtracting "1" from the number of assignable musical tone-generating channel numbers GACN, so as to find a musical tone-generating channel whose note number conforms to the note number NTNM. Specifically, it is judged whether or not the note number is the same with the note number NTNM and the sound generation volume is less than ten times as much as the sound generation volume for evaluation, for each musical tone-generating channel number corresponding to the musical tone-generating channel number MASS[TASN] of the target assign order TASN from the assign order next to the target assign order TASN to the one obtained by subtracting "1" from the number of assignable musical tone-generating channels GACN in the musical tone-generating channel management map which is investigated in the assigning order. When there is a musical tone-generating channel in which the note number is the same as the note number NTNM and the sound generation volume is less than ten times as much as the sound generation volume for evaluation, the assign order is rearranged so that the musical tone-generating channel in question becomes the target to be assigned. When there is no musical tone-generating channel in which the note number is the same as the note number NTNM and the sound generation volume is less than ten times as much as the sound generation volume for evaluation, the assign order is not rearranged. Upon completion of the processing, the process goes to step B5.

Modification 4

In this modified embodiment, a new musical tone is assigned in the following way:

If a musical tone-generating channel of the target assign order has completed a sound generation, a musical tone is assigned to this channel. If the musical tone-generating channel of the target assign order has not completed sound generation and has a successive strike relation with a new note-on message, a musical tone is assigned to the musical tone generating channel of the target assign order. On the other hand, if the musical tone-generating channel of the target assign order has not completed a sound generation, and if there is an assignable musical tone-generating channel having a successive strike relation with a new note-on message, a musical tone is assigned to this channel having the successive strike relation only where the assign order hypothetically set for this assignable channel having the successive strike relation is smaller than the target assign order.

If there is no assignable musical tone-generating channel having a successive strike relation with a new note-on message, or if the hypothetical assign order number of the assignable channel having the successive strike relation is not smaller than the target assign order, a musical tone is assigned to the musical tone-generating channel of the target assign order.

Now, the application of this modification to the second embodiment is described in the following.

Prior to the processing of step B5 of main assigner task, the following processing is executed:

[B5p] In the judgment of step B4, when the target assign order TASN is less than the number of assignable musical tone-generating channels GACN:

(1) It is judged whether or not the stage number of the musical tone-generating channel number corresponding to the musical tone-generating channel number MASS[TASN] of the target assign order TASN in the musical tone-generating channel management map exceeds "0". When the stage number exceeds "0", the process advances to the next (2). When it does not exceed "0", or in other words when sound generation has been finished, the process goes to step B5.

(2) It is judged whether of not the musical tone-generating channel of the target assign order TASN has a successive strike relation with a new note-on musical tone. Specifically, a decision is made whether or not the note number of the musical tone-generating channel number corresponding to the musical tone-generating channel number MASS[TASN] of the assign order TASN in the musical tone-generating channel management map is identical with the note number NTNM. When these note numbers conform to each other, the process advances to step B5. Otherwise, the process advances to the next (3).

(3) It is judged whether or not the successive strike flag of the musical tone-generating channel number corresponding to the musical tone-generating channel number MASS[TASN] of the target assign order TASN in the musical tone-generating channel management map is "1". When this flag is "1", the process advances to step B5. Otherwise, the process advances to the next (4).

(4) Each musical tone-generating channel corresponding to the musical tone-generating channel number MASS[TASN] of the assign order TASN is investigated in the assignment order from the assign order next to the target assign order TASN to the one obtained by subtracting "1" from the number of assignable musical tone-generating channel numbers GACN, so as to find a musical tone-generating channel whose note number conforms to the note number NTNM. Specifically, it is judged whether or not the note number is the same with the note number NTNM, for each musical tone-generating channel number corresponding to the musical tone-generating channel number MASS[TASN] of the assign order TASN from the assign order next to the target assign order TASN to the one obtained by subtracting "1" from the number of assignable musical tone-generating channels GACN in the musical tone-generating channel management map which is investigated in the assigning order. When there is a musical tone-generating channel in which the note number is the same as the note number NTNM, the process advances to the next (5). Otherwise, the process goes to step B5.

(5) First, the assign order of the musical tone-generating channel whose note number is the same as the note number NTNM is changed on imaginary base by the same successive strike processing as in the update processing 11 routine. In other words, a new assign order is obtained on the assumption that assign order has been updated because of a new note-on message, and a judgment is made whether or not the imaginary new assign order number is smaller than the target assign order TASN. When the former assign order number is smaller than the target assign order TASN, the assign order is rearranged so that the applicable musical tone-generating channel has the target assign order. The assign order is not changed when the imaginary assign order number is not smaller than the target assign order TASN. Upon completion of this processing, the process goes to step B5.

In any of the embodiments and modified examples, a musical tone-generating channel may be treated in the same way as a channel which has finished sound generation, if its sound generation volume is smaller than a predetermined level with which a tone-generating channel may be considered to have virtually finished a sound generation.

Furthermore, a musical tone-generating channel may have an earlier assign order number than in the case where a plurality of successive-strikes occur. For example, when there are three channels which are generating a musical sound of the same pitch, the preassigner sound generation volume of a channel with the smallest sound generation volume is decreased to 1/100, and that of a channel with the second smallest sound generation volume is decreased to 1/10, in the first embodiment. In the second embodiment, the state of a musical tone-generating channel of the earliest assign order is changed so that the channel has a later assign order number, and the assign order of a channel with the second smallest generation volume is changed so that the channel has an earlier assign order number than other channels in the same state.

According to the present invention, a truncate inhibit phase number is used as the phase number in which attack is finished. However, where the period of having large influence on a musical performance immediately after the beginning of a sound generation is longer, the invention may be modified according to this period. For example, a decay period may be included.

This invention may be applied to a multi-timbral electronic musical instrument. In this case, whether the channels have the same part or not is also judged to identify a successive strike relation. However, relating parts may be included in the judging subject if necessary.

In the first and second embodiments, examples of multi-task processing are disclosed. A single task processing may also be used. In this case, the same processing as in the preassigner task may be executed based on interruption such as a timer interrupt. Also, the same processing as in the preassigner task may be executed for assigning key data to a musical tone-generating channel in the main routine.

When key data are assigned to a musical tone-generating channel in the step B5 of main assigner task in the first and second embodiments, an assignment may be made in the following preferential order: An empty channel in which sound generation has been finished has the highest priority for the assignment. When there is no empty channel, a channel having a successive strike relation is searched out, and key data are assigned to this channel. If there is no channel having a successive strike relation, key data may be assigned in the order of sound generation volume for evaluation. When there is no empty musical tone-generating channel, after changing the sound generation volume for evaluation of a musical tone-generating channel having a successive strike relation, key data may be assigned according to the changed sound generation volume for evaluation. In the successive strike processing, a musical tone based on new key data may be included. Furthermore, second to the musical tone-generating channel in which a sound generation has been finished, key data may be assigned to a musical tone-generating channel whose sound generation volume is lower than a predetermined level with which the channel may be considered to have virtually finished sound generation.

This invention is applicable not only to a electronic keyboard musical instrument but also to other electronic musical instruments without keyboards, such as an automatic rhythm apparatus, and a sound-generating unit which generates musical tones based on the performance information given from an automatically performing apparatus. When the invention is applied to an automatic rhythm apparatus, whether the musical tones have the same timbre or not is also judged to an identify successive strike relation.

What is claimed is:

1. An assigning device for an electronic musical instrument which selects a musical tone-generating channel to assign a new musical tone, comprising:

(a) successive-strike detecting means for detecting musical tone-generating channels having a successive strike relation from among channels which are in a sound-generating condition;

(b) altering means for altering a predetermined preferential order rule so that a musical tone-generating channel, that is detected by said detecting means to have a successive strike relation, is preferentially selected, at least from among the musical tone-generating channels which are in the sound-generating condition, to be assigned a new musical tone according to an assigning order based on said predetermined preferential order rule; and (c) order selecting means for preliminarily determining the order of selecting of a musical tone-generating channel to which a new musical tone is assigned according to the assigning order based on said predetermined preferential order rule as altered by said altering means.

2. An assigning device for an electronic musical instrument which selects a musical tone-generating channel to assign a new musical tone, comprising:

(a) successive-strike detecting means for detecting musical tone-generating channels having a successive strike relation from among channels which are in a sound-generating condition;

(b) altering means for altering a predetermined preferential order rule so that a musical tone-generating channel, that is detected by said detecting means to have a successive strike relation, is preferentially selected at least from among the musical tone-generating channels which are in the sound-generating condition, to be assigned a new musical tone according to an assigning order based on said predetermined preferential order rule; and (c) channel selecting means for selecting a musical tone-generating channel to assign a new musical tone based on said predetermined preferential order rule as altered by said altering means.

3. An assigning device for an electronic musical instrument which selects a musical tone-generating channel to assign a new musical tone, comprising:

(a) successive-strike detecting means for detecting musical tone-generating channels having a successive strike relation from among channels which are in a sound-generating condition;

(b) altering means for altering a predetermined preferential order rule so that a musical tone-generating channel that is detected by said detecting means to have a successive strike relation, is preferentially selected from among the musical tone-generating channels which are in the sound-generating condition, to be assigned a new musical tone according to the assignment order based on said predetermined preferential order rule; and (c) channel selecting means for preferentially selecting a musical tone generating channel for assignment of a new musical tone, whereby:

at first, in a case wherein a musical tone-generating channel is in a sound-generation finished condition, the musical tone-generating channel in the sound-generation finished condition is selected; and next, in a case wherein there is no musical tone-generating channel in the sound-generation finished condition and all musical tone-generating channels are in the sound generating condition, a musical tone-generating channel based on said predetermined preferential order rule as altered by said altering means is selected.

4. An assigning device for an electronic musical instrument which selects a musical tone-generating channel to assign a new musical tone, comprising:

(a) successive-strike detecting means for detecting musical tone-generating channels having a successive strike relation from among channels which are in a sound-generating condition;

(b) altering means for altering a predetermined preferential order rule so that a musical tone-generating channel, that is detected by said detecting means to have a successive strike relation, is preferentially selected from among the musical tone-generating channels which are in the sound-generating condition, to be assigned a new musical tone according to an assigning order based on said predetermined preferential order rule; and (c) channel selecting means for preferentially selecting a musical tone generating channel for assignment of a new musical tone, whereby:

in a case wherein a musical tone-generating channel, which is to be assigned based on a preliminarily determined selecting order for musical tone-generating channels for assigning a new musical tone thereto, is in a sound-generation finished condition, the musical tone-generating channel in the sound-generation finished condition is selected; and next, in a case wherein a musical tone-generating channel, which is to be assigned based on a preliminarily determined selecting order for musical tone-generating channels for assigning a new musical tone thereto, is not in a sound-generation finished condition, a musical tone-generating channel based on said predetermined preferential order rule as altered by said altering means is selected.

5. The assigning device according to any one of claims 1, 2, 3 or 4, wherein said predetermined preferential order rule provides that priority is given to a musical tone-generating channel having a smaller sound generation volume.

6. The assigning device according to any one of claims 1, 2, 3 or 4, wherein said predetermined preferential order rule provides that priority is given to musical tone-generating channels that are at least in a note-off sound generating condition over those in a note-on sound generating condition.

7. The assigning device according to any one of claims 1, 2, 3 or 4, wherein said predetermined preferential order rule provides that priority is given to musical tone-generating channels that are at least in a note-off sound generating condition over those in a note-on sound generating condition, and among the musical tone-generating channels that are at least in the note-off sound generating condition, said subject of said predetermined preferential order provides that priority is given to a musical tone-generating channel having a smaller sound generation volume.

8. The assigning device according to claim 6, wherein said note-on and note-off sound-generating conditions refer to the sound-generating conditions relating to key depression and key release, respectively.

9. The assigning device according to claims 1 or 2, wherein said predetermined preferential order rule provides that priority is given to a musical tone-generating channel in a sound generation-finished condition over that in the sound-generating condition.

10. An assigning device for an electronic musical instrument which selects a musical tone-generating channel to assign a new musical tone, comprising:

(a) successive-strike detecting means for detecting musical tone-generating channels having a successive strike relation from among channels which are in a sound-generating condition;

(b) channel selecting means for preferentially selecting a musical tone-generating channel that is detected by said detecting means to have the successive strike relation over channels which do not have the successive relation, and for selecting a musical tone-generating channel which is in a sound-generation finished condition from among those channels having the successive strike relation to assign a new musical tone.

11. As assigning device for an electronic musical instrument which selects a musical tone-generating channel to assign a new musical tone, comprising:

(a) successive-strike detecting means for detecting musical tone-generating channels having a successive strike relation from among channels which are in a sound-generating condition;

(b) channel selecting means for selecting a musical tone generating channel for assignment of a new musical tone, whereby:

at first, in a case wherein a musical tone-generating channel is in a sound-generation finished condition, the musical tone-generating channel in the sound-generation finished condition is selected; and next, in a case wherein there is no musical tone-generating channel in the sound-generation finished condition and all the musical tone-generating channels are in the sound generating condition, a musical tone-generating channel detected by said successive strike detecting means is selected.

12. An assigning device for an electronic musical instrument which selects a musical tone-generating channel to assign a new musical tone, comprising:

(a) successive-strike detecting means for detecting musical tone-generating channels having a successive strike relation from among channels which are in a sound-generating condition;

(b) channel selecting means for preferentially selecting a musical tone generating channel for assignment of a new musical tone, whereby:

in a case wherein a musical tone-generating channel, which is to be assigned based on a preliminarily determined selecting order for musical tone-generating channels for assigning a new musical tone thereto, is in a sound-generation finished condition, the musical tone-generating channel in the sound-generation finished condition is selected; and next, in a case wherein a musical tone-generating channel, which is to be assigned based on the preliminarily determined selecting order for musical tone-generating channels for assigning a new musical tone thereto, is not in the sound-generation finished condition, a musical tone-generating channel detected by said successive strike detecting means is selected.

13. The assigning device according to claim 7, wherein said note-on and note-off sound-generating conditions refer to the sound-generating conditions relating to key depression and key release, respectively.

* * * * *